US007489891B2

(12) United States Patent
Tomita

(10) Patent No.: US 7,489,891 B2
(45) Date of Patent: Feb. 10, 2009

(54) IMAGE-FORMING APPARATUS, PROCESS CARTRIDGE AND IMAGE-FORMING METHOD

(75) Inventor: Masami Tomita, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 345 days.

(21) Appl. No.: 11/512,385

(22) Filed: Aug. 30, 2006

(65) Prior Publication Data

US 2007/0065183 A1 Mar. 22, 2007

(30) Foreign Application Priority Data

Sep. 16, 2005 (JP) ..... 2005-271172

(51) Int. Cl.
*G03G 15/08* (2006.01)

(52) U.S. Cl. ..... 399/252; 399/258; 430/111.4

(58) Field of Classification Search ..... 399/252, 399/255, 258, 262; 430/110.1, 111.4
See application file for complete search history.

(56) References Cited

U.S. PATENT DOCUMENTS

| | | | |
|---|---|---|---|
| 4,562,136 | A | 12/1985 | Inoue et al. |
| 4,590,141 | A | 5/1986 | Aoki et al. |
| 4,758,489 | A | 7/1988 | Tomita et al. |
| 4,762,763 | A | 8/1988 | Nomura et al. |
| 4,888,263 | A | 12/1989 | Tomita et al. |
| 4,931,374 | A | 6/1990 | Tomita et al. |
| 5,164,774 | A | 11/1992 | Tomita et al. |
| 5,225,303 | A | 7/1993 | Tomita et al. |
| 5,244,765 | A | 9/1993 | Katoh et al. |
| 5,474,869 | A | 12/1995 | Tomita et al. |
| 5,721,083 | A | 2/1998 | Masuda et al. |
| 5,840,456 | A | 11/1998 | Tomita et al. |
| 5,851,716 | A | 12/1998 | Kuramoto et al. |
| 5,975,446 | A | 11/1999 | Yaguchi et al. |
| 6,074,794 | A | 6/2000 | Fushimi et al. |
| 6,103,441 | A | 8/2000 | Tomita et al. |

(Continued)

FOREIGN PATENT DOCUMENTS

JP 2-21591 5/1990

(Continued)

OTHER PUBLICATIONS

U.S. Appl. No. 11/734,895, filed Apr. 13, 2007, Yamashita, et al.

(Continued)

*Primary Examiner*—Robert Beatty
(74) *Attorney, Agent, or Firm*—Oblon, Spivak, McClelland, Maier & Neustadt, P.C.

(57) ABSTRACT

The present invention provides an image-forming apparatus containing an image bearing member, a latent electrostatic image forming unit, a developing unit, in which the developing unit contains an image developing unit, a developer supplying unit, and a developer container, the mass abundance ratio of the toner to the carrier is 80:20 to 95:5 in the developer container, the developer container contains a flexible pouched member which reduces its volume by reducing the internal pressure and a developer outlet to discharge the developer contained therein, the developer satisfies a relation of formula (1) where A denotes a percentage of voids calculated from a tap density of the toner and B denotes a degree of fluidity (sec/50g) of the developer at a toner coverage ratio of the carrier being 50%:

$$A \leqq 0.01 \times B - 0.2 \quad (1).$$

17 Claims, 6 Drawing Sheets

U.S. PATENT DOCUMENTS 6,363,229 B1 3/2002 Shiraishi et al.
6,660,443 B2 12/2003 Sugiyama et al.
6,682,866 B2 1/2004 Sugiyama et al.
6,740,460 B2 5/2004 Tomita et al.
6,756,175 B2 6/2004 Emoto et al.
6,787,280 B2 9/2004 Yamashita et al.
6,800,412 B2 10/2004 Sugiyama et al.
6,824,945 B2 11/2004 Emoto et al.
6,835,519 B2 12/2004 Sugiyama et al.
6,846,604 B2 1/2005 Emoto et al.
6,849,369 B2 2/2005 Yagi et al.
6,852,462 B2 2/2005 Emoto et al.
6,936,390 B2 8/2005 Nanya et al.
6,947,692 B2 9/2005 Kondo et al.
7,005,223 B2 2/2006 Yamashita et al.
7,033,718 B2 4/2006 Tomita et al.
7,050,741 B2 5/2006 Koike et al.
7,056,636 B2 6/2006 Tomita et al.
7,062,194 B2 6/2006 Yanagida et al.
7,065,316 B2 6/2006 Yanagida et al.
7,085,528 B2 8/2006 Shintani et al.
2001/0044059 A1 11/2001 Miyamoto et al.
2002/0098436 A1 7/2002 Miyamoto et al.
2003/0027066 A1 2/2003 Yamashita et al.
2003/0055159 A1 3/2003 Yamashita et al.
2003/0096185 A1 5/2003 Yamashita et al.
2004/0076901 A1 4/2004 Miyamoto et al.
2004/0131961 A1 7/2004 Watanabe et al.
2004/0136763 A1 7/2004 Murakami et al.
2004/0137356 A1 7/2004 Tomita et al.
2004/0157146 A1 8/2004 Tomita et al.
2004/0175641 A1 9/2004 Nanya et al.
2004/0209181 A1 10/2004 Higuchi et al.
2004/0213597 A1 10/2004 Yanagida et al.
2004/0229147 A1 11/2004 Higuchi et al.
2005/0002705 A1 1/2005 Shintani et al.
2005/0025520 A1 2/2005 Murakami et al.
2005/0036805 A1 2/2005 Murakami et al.
2005/0058922 A1* 3/2005 Magome et al. ..... 430/106.1
2005/0074264 A1 4/2005 Amemiya et al.
2005/0084271 A1 4/2005 Koike et al.
2005/0112488 A1 5/2005 Yamada et al.
2005/0163543 A1 7/2005 Satoh et al.
2005/0164108 A1 7/2005 Murakami et al.
2005/0180786 A1 8/2005 Yamada et al.
2005/0186498 A1 8/2005 Honda et al.
2005/0191081 A1 9/2005 Muraishi et al.
2005/0191574 A1 9/2005 Koike et al.
2005/0201783 A1 9/2005 Kurotaka et al.
2005/0208408 A1 9/2005 Uchinokura et al.
2005/0232665 A1 10/2005 Toshio et al.
2005/0232666 A1 10/2005 Ojimi et al.
2005/0250036 A1 11/2005 Emoto et al.
2005/0260516 A1 11/2005 Tomita et al.
2005/0271420 A1 12/2005 Arai et al.
2005/0277048 A1 12/2005 Tomita
2006/0013624 A1 1/2006 Kurotaka et al.
2006/0024097 A1 2/2006 Yamada et al.
2006/0039726 A1 2/2006 Shintani et al.
2006/0062594 A1 3/2006 Kawasumi et al.
2006/0093946 A1 5/2006 Miyamoto et al.
2006/0115286 A1 6/2006 Uchitani et al.
2006/0133834 A1 6/2006 Yoneda et al.
2006/0133837 A1 6/2006 Shimojo et al.
2006/0166123 A1* 7/2006 Masuda ..... 430/111.4

FOREIGN PATENT DOCUMENTS

JP 05203689 A * 8/1993
JP 9-204105 8/1997
JP 2001-324863 11/2001
JP 2002-6531 1/2002
JP 2002-72649 3/2002
JP 2002214916 A * 7/2002
JP 3379318 12/2002
JP 2004-29306 1/2004
JP 2004151442 A * 5/2004
JP 2004240100 A * 8/2004
JP 2004-264510 9/2004
JP 2005043606 A * 2/2005

OTHER PUBLICATIONS

U.S. Appl. No. 09/384,797, filed Aug. 27, 1999, Satoru Miyamoto.
U.S. Appl. No. 11/206,128, filed Aug. 18, 2005, Hiroshi Yamashita, et al.
U.S. Appl. No. 11/315,164, filed Dec. 23, 2005, Yoshiki Hozumi, et al.

* cited by examiner

IMAGE-FORMING APPARATUS, PROCESS CARTRIDGE AND IMAGE-FORMING METHOD

BACKGROUND OF THE INVENTION

1. Field of the Invention

The present invention relates to an image-forming apparatus such as copiers, facsimiles and printers, in which an image is formed by electrostatic copying process, a process cartridge which is provided in the image-forming apparatus, and an image-forming method which is used for the image-forming apparatus.

2. Description of the Related Art

The method for visualizing image information via latent electrostatic images, for example, electrophotography is now used in various fields. In electrophotography, a latent electrostatic image is formed on a photoconductor by charging and exposing, the image is developed with a developer containing toner, and visualized via transferring and fixing. The developers used herein are a two-component developer consisting of a carrier and a toner, and one-component developer consisting of a toner alone such as magnetic toner. The two-component developers have advantages of good controllability and are now used extensively, because a carrier takes charge of the functions of stirring, conveying and charging developers, and functions are separated as a developer. Especially, the developer containing a carrier coated with resin is excellent in charge control property and relatively easy to improve environmental dependency.

In a two-component developing apparatus, a toner and carrier contained in a developer container in a developing device. After the toner and carrier are stirred and frictional charged, a latent image on the latent image bearing member is developed by supplying a latent image bearing member such as conductor with the frictional charged toner and carrier by means of a developer bearing conveyer such as developing roll.

During the development of the latent image, the toner in the developer container in the developing device decreases in accordance with consumption, on the other hand, the carrier is not consumed and remains in the developer container. Therefore, the carrier is more frequently stirred in the developer container in comparison with the toner, and accordingly the ratio of the degraded carrier increases. If the ratio of the degraded carrier increases in the developer container, the charge amount of the toner will be unstable, and troubles occur, for example, image degradation is induced.

Conventionally, to suppress the image degradation due to carrier degradation as the above description, so called "trickle developing system" is proposed, that is, not only the toner but the carrier are appropriately supplied to the developer container, in addition, owing to supplying the carrier the excess two-component developer in the developer container is recovered (Japanese Patent Application Publication (JP-B) No. 2-21591).

The trickle developing system is that the degraded carriers are replaced by supplying new carriers in a developing device or a developer containing portion as well as the decreased toners are refilled. Refill and recovery of the two-component developer containing the carrier enable the degradation of the carrier in the developing device or a developer containing portion to be suppressed, and the constant developing properties of the two-component developer are maintained, and thus the image degradation caused by the fluctuation of the developing properties of the developer can be suppressed.

The developer, which is supplied to the developing device or the developer containing portion, is filled in a supplying device which is provided separately from each developing device. The developer is supplied to each developing device depending on the consumption of the developer in accordance with forming images.

In the above-described trickle developing system, the following systems are carried out: the system in which the toner and the carrier are independently supplied to the developing device, and the excess developer in the developer tank is recovered (for example, Japanese Patent Application Laid-Open (JP-A) No. 9-204105); and the system in which the toner and the carrier are preliminarily mixed, and the mixture of the toner and the carrier is filled in the supplying device, and this developer is supplied to the developing device (for example, JP-B 2-21591).

Among these developer supplying systems, in case of the former, there is a problem that the developer must be supplied after the mix ratio between the toner and the carrier is adjusted, thus the control is complicated.

On the contrary, in case of the latter, in the developer supplying device, the toner and the carrier are preliminarily in a mixed condition in the developer supplying device, the complicated process of the adjustment of the supplying ratio between the toner and the carrier is not needed, and moreover the device can be simplified.

However, in the latter system, a big difference in specific gravity between the toner and the carrier leads to the state that each of them tends to exist disproportionately when both are mixed and filled in the developer supplying device. In addition, as the toner and the carrier are different in flowability, the supplying properties are different between the toner and the carrier, when the developer is supplied from the developer supplying device to the developing device, the supplying ratio of the toner and the carrier fluctuates. If the supplying ratio of the toner and the carrier fluctuates, the charge amount of the carrier is variable in the developing device, and then the problem occurs that the stable developing property cannot be obtained.

To obtain the stable charge amount of the toner in the developing device, the developer must be supplied to the developing device with the ratio between the toner and the carrier therein at a constant rate.

As a unit which makes the toner and the carrier to be existed uniformly in the developer supplying device, for example, there is a method that the developer supplying device with a stirring member in the supplying device is used, and by the stirring member the toner and the carrier are stirred and mixed.

Japanese Patent Application Laid-Open (JP-A) No. 2004-29306 discloses a developer supplying device, or a cylindrical developer supplying device in which a spiral projection along the surface of the inner circumference, contains a developer supplying container having an opening portion to discharge a contained developer, which contains at least a projected rim provided to project from the inner wall to inward and form spirally toward the opening portion, and the developer which is transported by the projected rim in accordance with the rotation of the developer supplying container is supplied from the opening portion to the developer receiving device.

Japanese Patent Application Laid-Open (JP-A) No. 2004-264510 discloses a filling device providing a spiral screw by the name of auger. Specifically it discloses that the toner container in which a moving member such as a screw by the name of auger or a coil spring is provided, and a cylindrical toner container, so called screw bottle 15, in which a spiral projection 14 is formed along the surface of the inner circumference thereof.

In the filling device disclosed in Japanese Patent Application Laid-Open (JP-A) No. 2004-264510, by driving rotationally the rotation axis of the moving member, the toner in the developer supplying device is transported to the direction toward the outlet, and discharged from the outlet then supplied to the developer supplying portion.

By using these supplying device with the moving member, or the developing device in which the supplying device itself rotates, the developer in the supplying device is discharged absolutely without the remaining amount thereof additionally, the discharged developer can be surely transported to the developing device, the developer in the apparatus can be adequately stirred and mixed, then the toner and the carrier can be in the state of uniformly dispersed.

However, in case that the developer is stirred and mixed in the supplying device, the carrier deteriorates before supplied to the developing device. Therefore, it fails to obtain sufficiently the effect of trickle developing system that is the developing properties of the two-component developer can be constantly maintained by supplying the carrier before deterioration to the developing device.

Recently, the developer supplying device with the system that discharging mechanism such as an auger and a screw bottle is not contained in a toner container is proposed.

For example, Japanese Patent Application Laid-Open (JP-A) Nos. 2001-324863 and 2002-72649 disclose that the system with the toner in the pouched flexible container is suctioned with the suction pump, and supplied to the developing unit and it is already commercially available. These inventions disclose that the container can reduce its volume, that is the state of deflating a container by suctioning the toner therein after the toner is discharged from the container.

As described above by using the supplying device which does not have a stirring unit therein, the problem such that the carrier is deteriorated before supplying the developing device will not occur. A small-footprint device body can be realized, and in addition, at the time of recovery the amount of recovery per unit volume can be reduced compared with using a hard bottle for disposal.

However, as described above, when the developer which consists of the toner and the carrier and is filled in the developer supplying device without containing a stirring unit is supplied to the developing device, for example, in case that the developer outlet is provided on the lower side of the supplying device body, the carrier with heavier specific gravity moves easily to the lower side. Thus the phenomenon is likely to occur that the toner and the carrier disproportionately exist in the developer supplying device. When the property of the flowability differs largely between the toner and the carrier, the supplying property between them differs largely and the problem occurs that the stable charge amount of the toner cannot be obtained in the developing device.

SUMMARY OF THE INVENTION

The object of the present invention to provide an image-forming apparatus, process cartridge and the image-forming method in which the charge properties of the toner in the developing device can be maintained uniformly and obtain a stable image for a long period of time.

An image-forming apparatus of the present invention contains an image bearing member, a latent electrostatic image forming unit configured to form a latent electrostatic image on the image bearing member, a developing unit configured to develop the latent electrostatic image on the image bearing member with a developer comprising a toner and a carrier to form a toner image, wherein the developing unit comprises an image developing unit configured to supply the developer to the image bearing member so as to develop the latent electrostatic image, a developer supplying unit configured to supply the developer to the image developing unit, and a developer container contains the developer which is to be supplied to the image developing unit, wherein the mass abundance ratio of the toner to the carrier in the developer container is 80:20 to 95:5, wherein the developer container comprises a flexible pouched member which reduces its volume by reducing the internal pressure and a developer outlet to discharge the developer contained therein, wherein the developer satisfies a relation of formula (1), where A denotes a percentage of voids calculated from a tap density of the toner and B denotes a degree of fluidity (sec/50 g) of the developer at a toner coverage ratio of the carrier being 50:

$$A \leqq 0.01 \times B - 0.2 \quad (1)$$

A process cartridge contains an image bearing member bearing a latent electrostatic image, and at least an image developing unit disposed oppositely to the image bearing member bearing the latent electrostatic image, wherein the process cartridge is detachably attached to an image-forming apparatus.

The above-described image-forming apparatus is the image-forming apparatus of the invention.

An image-forming method contains forming a latent electrostatic image on an image bearing member, developing the latent electrostatic image with a developer comprising a toner and a carrier to form a toner image, transferring the toner image on a recording medium, fixing the toner image on the recording medium, wherein the developing is performed with an image developing unit configured to supply the developer to the image bearing member so as to develop the latent electrostatic image, a developer supplying unit configured to supply the developer to the image developing unit, and a developer container containing the developer which is to be supplied to the image developing unit, wherein the mass abundance ratio of the toner to the carrier in the developer container is 80:20 to 95:5, wherein the developer container comprises a flexible pouched member which reduces its volume by reducing the internal pressure and a developer outlet to discharge the developer contained therein, wherein the developer satisfies a relation of formula (1), where A denotes a percentage of voids of the toner calculated from a tap density of the toner and B denotes a degree of fluidity (sec/50 g) of the developer at a toner coverage ratio of the carrier being 50%:

$$A \leqq 0.01 \times B - 0.2 \quad (1).$$

Figure 1:
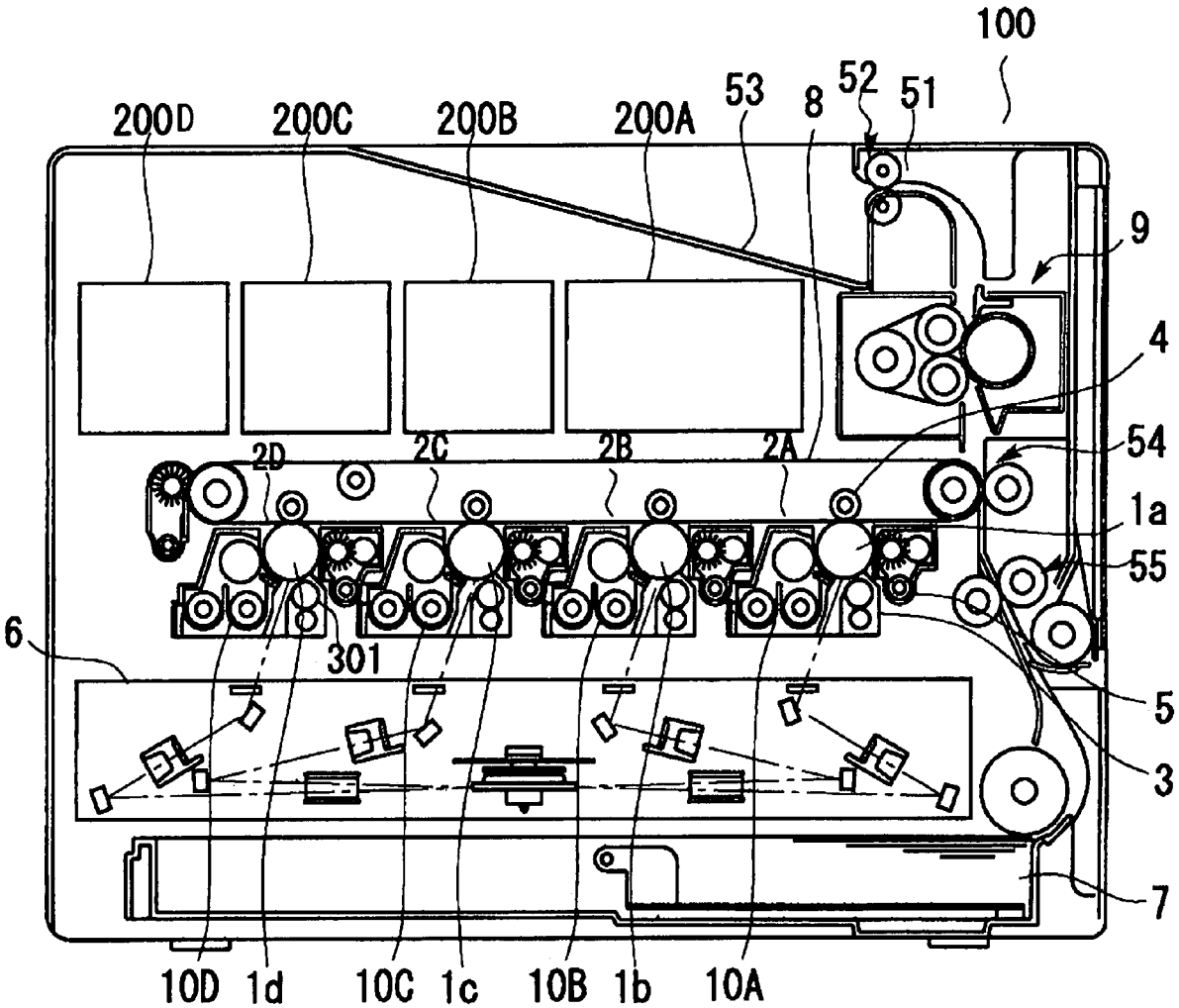
FIG. 1 is a schematic diagram showing an example of a structure of the image-forming apparatus of the present invention.

DESCRIPTION OF THE PREFERRED EMBODIMENTS (Image-Forming Apparatus and Image-Forming Method)

An image-forming method of the present invention contains at lest a latent electrostatic image forming step, a developing step, a transferring step and a fixing step, and it further contains other steps appropriately selected according to requirements such as a discharging step, a cleaning step, a recycling step and a controlling step.

An image forming apparatus of the present invention contains at least an image bearing member, a latent electrostatic image forming unit, a developing unit, a transferring unit and a fixing unit, and it further contains other units appropriately selected according to requirements such as a discharging unit, a cleaning unit, a recycling unit and a controlling unit.

The latent electrostatic image forming step is a step to form a latent electrostatic image on the image bearing member.

The image bearing member (hereinafter referring to as "electrophotographic photoconductor," "photoconductor," or "photoconductor drum") is not limited in terms of the material, shape, structure and size, and it can be appropriately selected from known ones. The shape of a drum is preferable. Examples of the material include an inorganic photoconductor such as amorphous silicon and selenium and an organic photoconductor such as polysilane and phthalopolymethine.

The latent electrostatic image may be formed, for example, by charging uniformly the surface of the image bearing member followed by exposing image wisely, which may be performed by the latent electrostatic image forming unit. The latent electrostatic image forming unit contains at least a charging unit configured to charge uniformly the surface of the image bearing member and an exposing unit configured to expose imagewisely on the image bearing member.

The charging may be performed, for example, by applying a voltage on the surface of the image bearing member with the charging unit.

The charging unit is not particularly limited and can be appropriately selected according to applications. Examples thereof include a contact charging unit, which itself is the known, having a conductive or semiconductive roll, a brush, a film or a rubber blade, and a noncontact charging unit utilizing corona discharge such as corotron and scorotron.

The exposing may be performed, for example, by exposing imagewisely the surface of the image bearing member with the exposing unit.

The exposing unit is not particularly limited as long as it can expose imagewisely to be formed on the surface of the image bearing member charged by the charging unit, and it can be appropriately selected according to applications. Examples of the exposing unit include a copying optical system, a rod lens array system, a laser optical system and liquid crystal shutter optical system.

In the present invention, the back-exposure method may be adopted in which expose imagewisely from the back side of the image bearing member.

Developing Step and Developing Unit

The developing step is a step to develop the latent electrostatic image using the toner or the developer to form a toner image or visible image, which may be performed by the developing unit.

The developing unit contains an image developing unit configured to supply the developer to the image bearing member so as to develop the latent electrostatic image formed thereon, a developer supplying unit configured to supply the developer to the image developing unit, and a developer container containing the developer which is to be supplied to the image developing unit.

The developer container contains a flexible pouched member which reduces its volume by reducing the internal pressure and a developer outlet to discharge the developer contained therein.

These will be described in detail hereinafter.

Transferring Step and Transferring Unit

The transferring step is a step to transfer the visible image to a recording medium. The transferring process preferably has an aspect that with an intermediate transferring member, it performs a primary transfer to transfer the visible image to the intermediate transferring member followed by a secondary transfer to transfer the visible image to the recording medium. The transferring process more preferably has an aspect which includes a primary transferring step that transfers the visible image to the intermediate transferring member to form a complex transfer image, and a secondary transferring step that transfers the complex transfer image to the recording medium using a toner having two or more colors or preferably a full-color toner.

The transferring the visible image may be performed by charging the image bearing member, i.e. photoconductor, using a transfer charging unit, and it may be performed by the transferring unit. The transferring unit preferably has an aspect that includes a primary transferring unit configured to transfer a visible image to an intermediate transferring member to form a complex transfer image and a secondary transferring unit configured to transfer the complex transfer image to a recording medium.

The intermediate transferring member is not particularly limited and can be appropriately selected according to applications from the known transferring member. Preferable examples include a transfer belt.

The transferring unit, that is the primary transferring unit and the secondary transferring unit, preferably contains at least a transferring unit configured to release and charge the visible image formed on the image bearing member, i.e. photoconductor, to the recording medium. There may be one transferring unit, or there may be two or more.

Examples of the transferring unit include a corona transferring unit by corona discharge, a transfer belt, a transfer roller, a pressure transfer roller and an adhesive transferring unit.

The recording medium is not particularly limited and can be appropriately selected according to applications from the known recording medium or recording paper.

Fixing Step and Fixing Unit

The fixing step is a step to fix the visible image transferred to the recording medium by means of a fixing unit. It may be performed every time the toner of each color is transferred to the recording medium, or it may be performed at once when the toner of all the colors is laminated.

The fixing unit is not particularly limited and can be selected appropriately according to applications. The known hot-pressing unit is preferable. Examples of the hot-pressing unit include a combination of a heat roller and a pressure roller and a combination of a heat roller, a pressure roller and an endless belt.

The heating temperature in the hot-pressing unit is preferably 80° C. to 200° C.

In the present invention, the known optical fixing unit, for example, may be used along with or in place of the fixing step and the fixing unit according to applications.

Other Steps and Other Units

The discharging step is a step to discharge the image bearing member by applying a discharging bias, and it may be preferably performed by a discharging unit.

The discharging unit is not particularly limited as long as the discharging bias is applied to the image bearing member. It can be appropriately selected from the known discharging units, and preferable examples include a discharge lamp.

The cleaning step is a step to remove the residual toner on the image bearing member, and it may be preferably performed by a clearing unit.

The cleaning unit is not particularly limited as long as it can remove the electrophotographic toner remaining on the image bearing member, and it can be appropriately selected from the known cleaners. Preferable examples thereof include a magnetic brush cleaner, a static brush cleaner, a magnetic roller cleaner, a blade cleaner, a brush cleaner and a web cleaner.

The recycling step is a step to recycle the toner removed in the cleaning step to the developing unit, and it may be preferably performed by a recycling step.

The recycling unit is not particularly limited, and the known transporting unit may be used.

The controlling step is a step to control each of the above-described steps, and it may be preferably performed by a controlling unit.

The controlling step is not particularly limited as long as it can control the behavior of each of the units appropriately selected according to requirements. Examples thereof include equipment such as a sequencer and a computer.

FIG. 1 is an example of a schematic diagram showing the structure of the image-forming apparatus of the present invention which applied to a compact full-color printer.

In an image-forming apparatus body (hereinafter referring to as an "apparatus body") 100, image-forming units 2A, 2B, 2C and 2D having four photoconductor drums 1 as image bearing members are respectively mounted detachably to the apparatus body 100. In the approximate center of the apparatus body 100, a transfer unit is disposed in which transfer belt 8 is disposed rotatably anticlockwise among a plurality of rollers 4.

In each image-forming unit 2A, 2B, 2C and 2D, the photoconductor drums 1*a*, 1*b*, 1*c* and 1*d* are respectively disposed so as to contact with the lower surface of the transfer belt 8. Then, developing devices 10A, 10B, 10C and 10D served as image developing units are disposed corresponding to the image-forming units 2A, 2B, 2C and 2D, in which each color of the toner used is different.

The image-forming units 2A, 2B, 2C and 2D are the units having the same construction, and the image-forming unit 2A forms an image corresponding to magenta color, the image-forming unit 2B forms an image corresponding to cyan color, the image-forming unit 2C forms an image corresponding to yellow color, the image-forming unit 2D forms a image corresponding to black color.

A two-component developer containing a toner and a carrier is used in developing devices (image developing units) 10A, 10B, 10C and 10D disposed in each image-forming units 2A, 2B, 2C and 2D. The trickle developing system is adopted, which is the toner is supplied from a developer supplying unit described below depending on the sensor of the toner density, at the same time, the carrier is supplied and an old developer is discharged and the developer can be exchanged.

Figure 2:
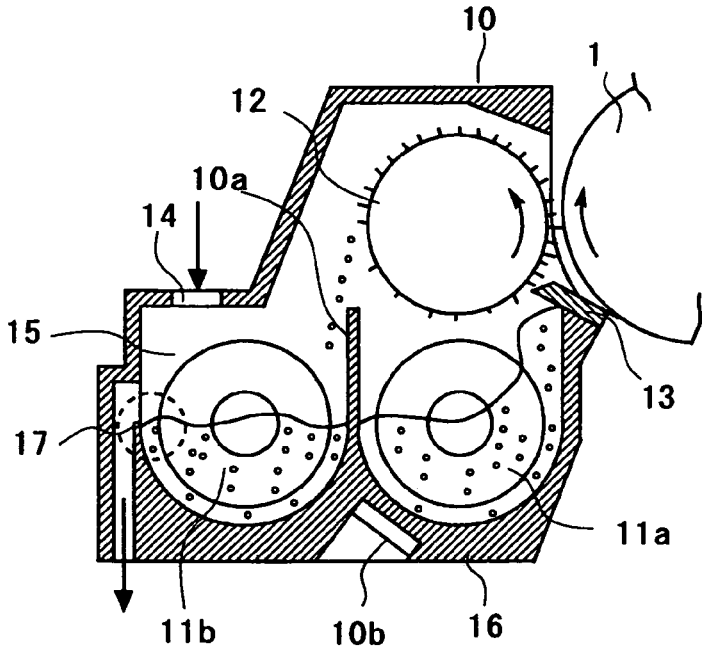
FIG. 2 is a schematic structure showing an example of a structure at the periphery of the developing portion of the image developing unit relating to the embodiment of the present invention.

In the space above the image-forming units 2A, 2B, 2C and 2D, is developer supplying parts 200A, 200B, 200C and 200D are disposed and used for the trickle developing system. Each of the developer supplying parts 200A, 200B, 200C and 200D contains a developer supplying unit and a developer container, and is constructed so as to supply a new toner, which is different from the toner to be supplied to photoconductor drum 1*a*, 1*b*, 1*c* and 1*d*, and a new carrier to the developing devices (image developing units) 10A, 10B, 10C and 10D. The construction of the image developing unit is shown in FIG. 2.

Under the image-forming units 2A, 2B, 2C and 2D, an exposing device 6 is disposed as a writing unit. The exposing device 6 consists of four light sources of a laser diode (LD) system for each color, a pair of polygon scanner which consist of polygon mirror having six surfaces and polygon motor, fθ lens disposed in a line of each light source, and lenses and mirrors such as a long cylindrical lens. A laser light exposed from the laser diode is deflected and scanned with the polygon scanner and exposed onto each of the photoconductors 1*a*, 1*b*, 1*c* and 1*d*.

A fixing device 9 served as the fixing unit is disposed to fix a transferred image on a transfer paper between the transfer belt 8 and the developer supplying part 200. In the downstream of the conveying direction of the transfer paper in the fixing device (fixing unit) 9, a paper ejection path 51 is formed, on which the transfer paper conveyed can be ejected on an output tray 53 by means of a pair of paper ejection rollers 52.

In the apparatus body 100, a feeding cassette 7 is disposed, in which the transfer paper can be stored.

Next, the operation of the image-forming apparatus 100 in image formation will be illustrated. When image formation is started, each photoconductor drum 1 respectively rotates in clockwise direction as shown in FIG. 1. Then, the surface of the photoconductor drum 1 is uniformly charged by the charge roller 301 of charging unit 3. Then, a laser light corresponding to a magenta image to the photoconductor drum 1*a* in the image-forming unit 2A, a laser light corresponding to a cyan image to the photoconductor drum 1*b* in the image-forming unit 2B, a laser light corresponding to a yellow image to the photoconductor drum 1*c* in the image-forming unit 2C, and a laser light corresponding to a black image to the photoconductor drum id in the image-forming unit 2D are respectively exposed with the exposing device 6, then a latent image corresponding to image data of each color is respectively formed. When each latent image is located at each developing device 10A, 10B, 10C and 10D by the rotation of the photoconductor drum 1, each latent image is developed using each magenta, cyan, yellow and black toner and a four-color toner image is formed.

On the other hand, transfer paper is fed by separate-feeding portion from feeding cassette 7, and the transfer paper is conveyed in synchronism with the toner image formed on each photoconductor drum 1 by a pair of resist rollers 55 disposed in front of transfer belt 8. The transfer paper is positively charged by a paper absorption roller 54 disposed in the vicinity of the entrance of transfer belt 8, thereby absorbed electrostatically to the surface of transfer belt 8. Then, while the transfer paper is conveyed with absorbing on the transfer belt 8, each toner image of magenta, cyan, yellow and black color is sequentially transferred on the transfer paper, thereby forming a full-color toner image by superpositioning four colors. The toner image is melted and fixed on the transfer paper by heating and applying voltage with the fixing device (fixing unit) 9, and then the transfer paper is ejected via the paper ejection system on the output tray 53 disposed in the upper area in the apparatus body 100.

Developing Unit

Next, the developing unit, which contains the image developing unit 10, and the developer supplying part 200 including a developer supplying unit and a developer container, used in the image-forming apparatus 100 of the present invention will be described in detail.

Image Developing Unit

FIG. 2 is a schematic structure showing an example of the structure at the periphery of the developing portion of the developing device (image developing unit) 10 relating to the embodiment of the present invention.

Each of the developing devices (image developing units) 10A, 10B, 10C and 10D consists of a developing roller 12 disposed so as to face the photoconductor drum 1, transporting screws 11*a* and 11*b* which transport and stir the developer, a sensor of the toner density 10*b*, and the like. The developing roller 12 consists of a rotatable sleeve outside and a magnet fixed inside.

The developing device (image developing unit) 10 is so called a two-component developing device and uses a developer containing a mixture of toner and carrier. The developer stored in developing device (image developing unit) 10 is stirred with two transporting screws 11*a* and 11*b* while circulating in the space partitioned with a partitioning member 10*a*. Then, the developer transported near the developing roller 12 as the developer bearing member is maintained on the surface of the developing roller 12 by the magnetic attraction of a magnetic provided in the developing roller 12 (not shown). After the developer maintained on the surface of developing roller 12 is controlled to the predetermined thickness by a doctor blade 13 corresponding to the rotation of the developing roller 12, the latent electrostatic image on the photoconductor drum 1 is developed at the position facing to the photoconductor drum 1.

When developing with the developing device (image developing unit) 10, the toner is gradually decreased as consumed by adhering to the latent electrostatic image on the photoconductor drum 1. When the reduction in the toner amount is sensed with the sensor of toner density 10*b*, the two-component developer is supplied from the developer supplying part 200. The newly supplied two-component developer is stirred with transporting screws 11*a* and 11*b* in the stirring portion 15, and is well stirred and mixed with the two-component developer contained before supplying.

In the developer containing tank 16 in the developing device 10, a gate portion 17 is provided to overflow an excess developer in order to keep the constant amount of the developer contained in the tank. The developer overflowed from the gate portion 17 is ejected to a recovery portion (not shown). The recovery portion of the overflowed developer is not limited to be provided inside of developer containing the tank 16, and the gate portion 17 can be fixed on the outside of the developing device (image developing unit) 10.

Developer Supplying Part

The construction of the developer supplying unit 200 used in the embodiment will be illustrated with reference to the drawings hereinafter.

The developer supplying portion 200 consists of the developer container 230 containing a developer containing member 231 which is a flexible pouched member capable of reducing its volume, and developer supplying unit 220 which supplies the developer contained in the developer container 230 to the developing device (image developing unit) 10.

Figure 3:
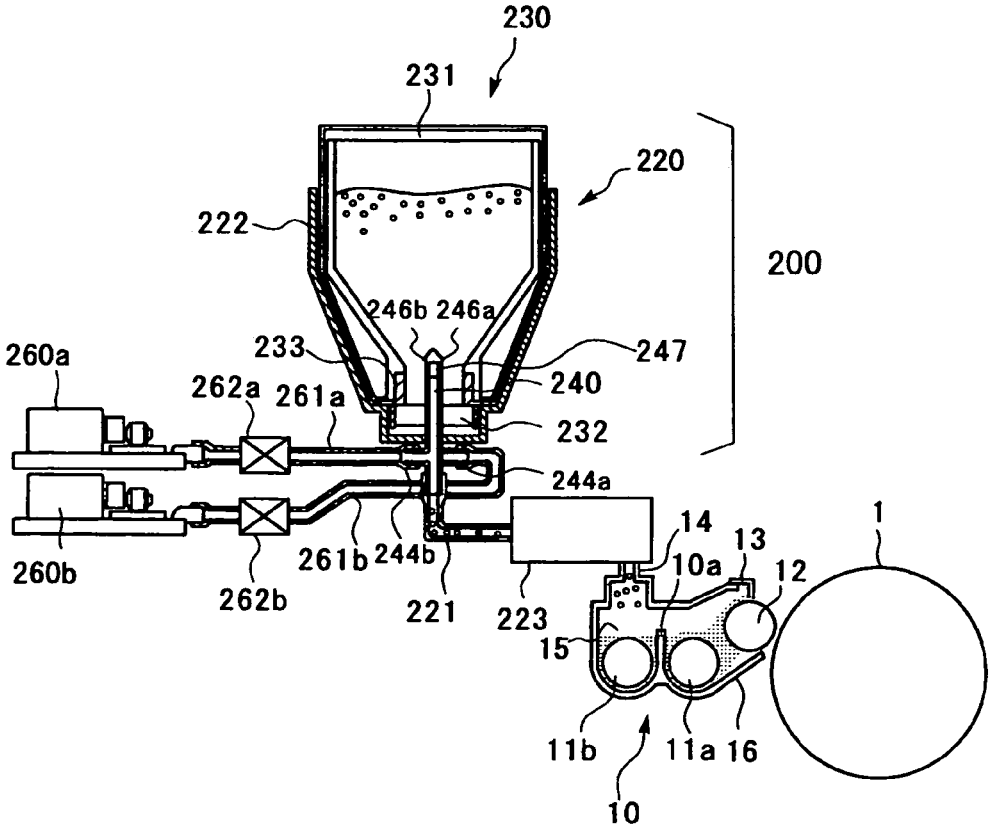
FIG. 3 is a schematic structure showing an example of a developer supplying part which is used in the present invention.

FIG. 3 is a schematic structure showing an example of the developer supplying part 200 which is used in the present invention.

The developer supplying portion 200 has a screw pump 223 connected to a developer supplying port 14 in the developing device (image developing unit) 10 and a transporting tube 221 which is connected with the screw pump 223 as a developer transporting passage. The transporting tube 221 may be preferably made from a rubber material such as polyurethane, nitrile, EPDM which is flexible and excellent in resistant property to toner. The developer supplying part 200 has a container holder 222 to support the developer container 230, and the container holder 222 is made from a highly rigid material such as a resin.

The developer container 230 has the developer containing member 231 made from a flexible sheet material as a flexible pouched member, and a cap portion 232 forming a developer outlet as an outlet forming member.

Preferable examples of the material of the developer containing member 231 include a plastic sheet such as polyester sheet, polyethylene sheet, and polyurethane sheet.

A seal material 233 made of sponge and rubber and the like is provided in a cap portion 232, and has a cut in shape of X therein. The developer container 230 and developer supplying unit 220 are communicatively connected and fixed to each other by passing the nozzle 240 of the developer supplying unit 220 through the cut shaped of X.

In the embodiment, the cap portion 232 is provided in the lower side of the developer container 230. This means that the developer container 230 is disposed in the developer supplying part 200 with the cap portion 232 being provided at the position containing a vertical portion in a downward direction in the developer container 230.

The position in which the cap portion 232 is provided in developer containing body is not limited, and may be provided horizontally or obliquely in the body of the developer container 230 in the condition that the developer container 230 is disposed in the developer supplying part 200.

The developer container 230 is sequentially replaced with the new one depending on the consumption of the toner. This construction allows the developer containing portion to be set and removed easily and prevents the toner leakage when replacing and using.

Figure 4A:
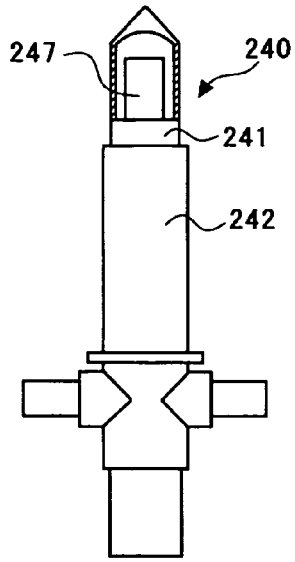
FIG. 4A is an outline drawing showing an example of a schematic structure of a nozzle which is mounted in the developer supplying unit.
Figure 4B:
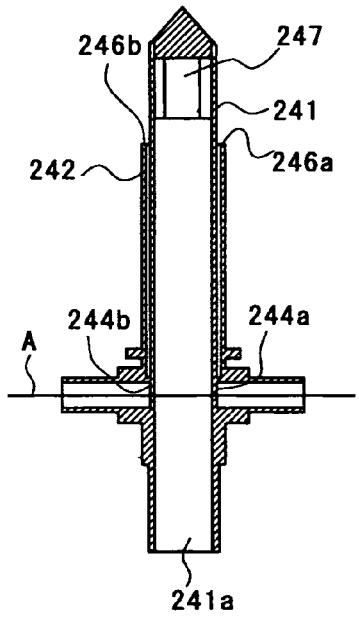
FIG. 4B is an example of an axial sectional view of the nozzle which is mounted in the developer supplying unit.
Figure 4C:
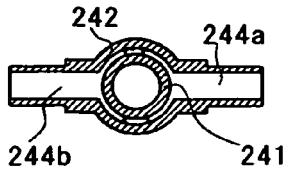
FIG. 4C is a cross-sectional view of an example of FIG. 4B along the line A-A.

FIG. 4A is an outline drawing showing an example of a schematic structure of the nozzle 240 which is mounted in the developer supplying unit 220, FIG. 4B is an example of an axial sectional view of the nozzle 240, and FIG. 4C is a cross-sectional view of an example of FIG. 4B along the line A-A. As shown in FIG. 4B, the nozzle 240 has a double tube structure consisting of an inner tube 241 and an outer tube 242 which houses inner tube 241 inside thereof. Inside of the inner tube 241 is a developer channel 241*a* as a developer transporting passage to discharge the developer in the developer container 230. The toner in the developer container 230 is suctioned via the developer channel 241*a* in the screw pump 223 due to the suction force by means of the screw pump 223.

Figure 5:
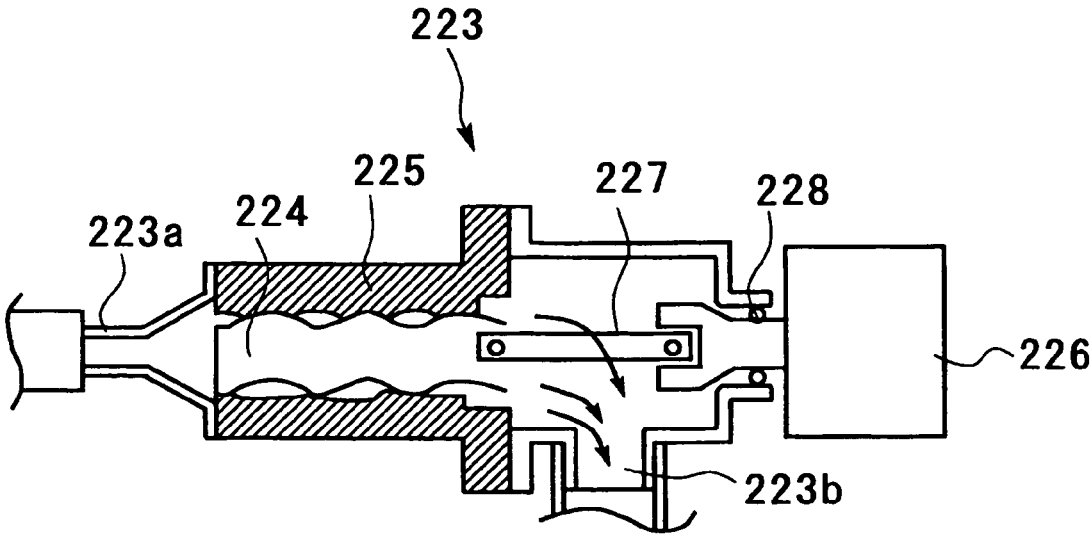
FIG. 5 is a cross-sectional view showing an example of a schematic structure of a screw pump.

FIG. 5 is a cross-sectional view showing an example of a schematic structure of a screw pump 223. The screw pump 223 is so called a uniaxial bias screw pump, in which a rotor 224 and a stator 225 are provided. The rotor 224 has a spirally-twisted circular cross section and is made of a rigid material and fits inside of the stator 225. On the other hand, the stator 225 is made of a rubberlike flexible material, and has a hole with spirally-twisted oval cross section and the rotor 224 is fitted in the hole. Spiral pitch of the stator 225 is formed in twice as long as spiral pitch of the rotor 224. The rotor 224 is connected to the drive motor 226 which rotary drives the rotor 224 via the universal joint 227 and bearing 228.

In this construction, the toner and carrier which are transported from the developer container 230 via the developer channel 241*a* in the nozzle 240 and transporting tube 221 from the toner suctioning opening 223*a* to the inside of screw pump 223. Then, the toner and carrier get into a space which is formed between the rotor 224 and stator 225, and are suctioned and transported in the right direction of FIG. 3 corresponding to the rotation of the rotor 224. After the toner goes through the space between the rotor 224 and the stator 225, the toner falls down below from the toner falling opening 223*b*, and supplied into the developing device (image developing unit) 10 via the developer supplying port 14 in the developing device (image developing unit) 10.

Air Supplying Passage

In the embodiment used in the developer supplying unit 220, an air supplying unit 260 is provided to supply air into the developer container 230.

As shown in FIG. 4B, the nozzle 240 in the developer supplying unit 220 has an air passage 244 between the inner tube 241 and the outer tube 242. As shown in FIG. 4C, the air passage 244 is constructed from two passages 244*a* and 244*b* each of which independently forms a semicircle cross section. As shown in FIG. 3, each air passage 244*a* and 244*b* via each air supplying passage 261*a* and 261*b* as a gas supplying passage is respectively connected to each air pump 260*a* and 260*b* as a gas deliver device. The air pumps 260*a* and 260*b* may be used air pumps of common diaphragm type. Air delivered from the air pumps 260*a* and 260*b*, respectively via the air passages 224*a* and 244*b* is supplied into the developer container 230 from the air supplying opening 246*a* and 246*b* as gas supplying opening in each air passage. Each air supplying opening 246*a* and 246*b* is disposed in the lower side of the toner discharging opening 247 as a developer outlet of the toner channel 241*a*. Therefore, the air supplied from the supplying opening 246*a* and 246*b* is supplied to the toner around the toner discharging opening 247, and even if a toner clogs in the toner discharging opening 247 owing to being left without use for a long period of time, the toner clogging up the toner discharging opening 247 can be broken.

In the air supplying passage 261*a* and 261*b*, on-off valves 262*a* and 262*b* are provided as closure units which open and close by a control signal from a controlling portion as a gas delivery controlling unit (not shown). When receiving ON signal from the controlling portion, the on-off valves 262*a* and 262*b* open to make air go through, and when receiving OFF signal from the controlling portion, the on-off valves 262*a* and 262*b* close to prevent air from going through.

Developer Supplying Operation

In this embodiment, the operation of the developer supplying unit 220 will be illustrated.

The above controlling portion starts a developer supplying operation on receiving a signal of lack of toner density from the developing device (image developing unit) 10. In the developer supplying operation, at first while the air pumps 260*a* and 260*b* are driven respectively to supply air into the developer container 230, and the drive motor 226 in the screw pump 223 is driven to suction and transport the developer.

When air is sent from the air pumps 260*a*, 260*b*, the air get into the air passages 244*a* and 244*b* in the nozzle 240 from the air supplying passage 261*a* and 261*b*, and is supplied from the air supplying openings 246*a* and 246*b* to the developer container 230. The air stirs the developer in the developer container 230 to make the developer contain much air, and thus fluidization of the developer is promoted.

When air is supplied into the developer container 230, the internal pressure in the developer container 230 increases. Therefore, a pressure difference occurs between the internal pressure in the developer container 230 and the external pressure (atmospheric pressure), and the force moving to the pulling direction by the pressure acts on the fluidized developer. Thus, the developer in the developer container 230 is discharged from the pulling direction by the pressure, that is, the developer discharging opening 247.

In this embodiment, as suction force also acts by the screw pump 223, the developer in the developer container 230 is discharged from the developer discharging opening 247.

As the above description, the developer discharged from the developer container 230 transferred from the developer discharging opening 247 through the developer channel 241*a* in the nozzle 240, and through the transporting tube 221 into the screw pump 223. After the developer moves in the screw pump 223, falling down below from the developer falling opening 223*b*, and the developer is supplied from the developer supplying port 14 into the developing device (image developing unit) 10. After a certain amount of the developer is supplied, the controlling portion stops the air pumps 260*a*, 260*b* and drive motor 226, and close the on-off valves 262*a* and 262*b*, thus the toner supplying operation is completed. By dosing the on-off valves 262*a* and 262*b* at the completion of the toner supplying operation, the toner in the developer container 230 is prevented to backflow through the air supplying passages 244*a* and 244*b* in the nozzle 240 to the air pumps 260*a* and 260*b*.

The amount of air supplied form the air pumps 260*a*, 260*b* is set less than the amount of the toner and the air suctioned by the screw pump 223. Therefore, the internal pressure of the developer container 230 is reduced in accordance with the consumption of the toner. In this embodiment, as the developer containing member 231 of the developer container 230 is made from a flexible sheet material, the developer containing member 231 reduces its volume according to the reduction of internal pressure.

Figure 6:
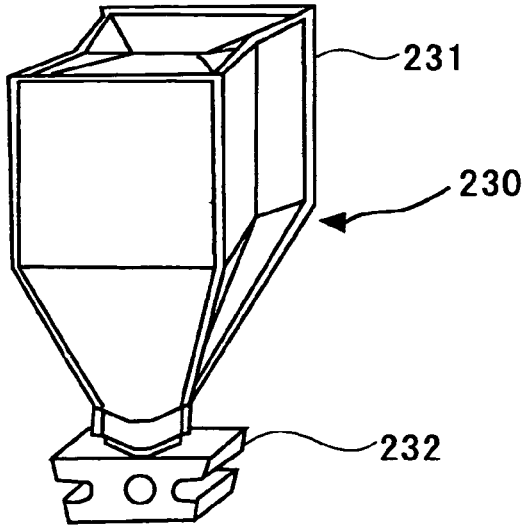
FIG. 6 is a perspective view showing an example of a condition that the developer is filled in the developer containing member.

FIG. 6 is a perspective view showing an example of the condition that the developer is filled in the developer containing member 231.

Figure 7:
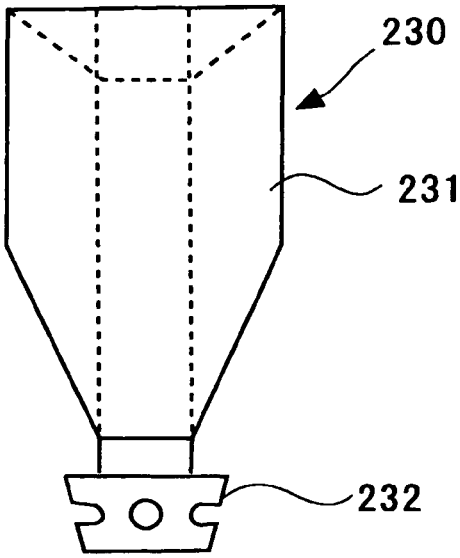
FIG. 7 is a front view showing an example of a condition that the developer in the developer containing member is discharged and the volume of the developer containing member is reduced.

FIG. 7 is a front view showing an example of the condition that the developer in the developer containing member 231 is discharged and its volume is reduced, i.e. deflates. 60% or more of the volume of the developer containing member 231 is preferably reduced.

In the developer container 230 shown in FIG. 6, a developer which consists of a new toner and carrier is contained, and the mass abundance ratio of the toner to the carrier (toner: carrier) is 80:20 to 95:5.

In the developer container 230, the mass abundance ratio of the toner to the carrier is less than 80 mass %, in the developer containing member 231, carriers coagulate each other, and it cannot obtain stable supplying property to the developing device (image developing unit) 10. When the mass abundance ratio of the toner to the carrier is more than 95 mass %, the amount of the carrier supplied to the developing device (image developing unit) 10 lacks compared to the amount of the toner, and then the stable charge mount of the toner cannot be obtained in the developing device (image developing unit) 10.

The carrier used in the present invention will be described hereinafter.

In the image-forming apparatus 100 adopting the trickle developing system, a new toner and carrier is supplied from the developer container 230 shown in FIG. 6 via the developer supplying port 14 to the developing device (image developing unit) 10. A new toner and carrier must be supplied with keeping the ratio of the toner and the carrier in the developer at a constant state.

As the developer supplying portion 200 shown in FIG. 3, a stirring member is not provided in the developer containing member 231, flowability of the developer therein is obtained by the air sent by means of the air supplying unit 260. When the property such as flowability or specific gravity between the toner of the developer contained in the developer containing member 231 and the carrier coated with the toner differs significantly from each other, the difference between these supplying properties is large. The developer of the higher supplying property is supplied from the developer discharging opening 247 into the developing device (image developing unit) 10, followed by the developer of the lower supplying property.

Especially, in case that the developer discharging opening 247 is provided in the lower side such as the developer container 230, the carrier is supplied precedently into the developing device (image developing unit) 10 and the supplying ratio between the toner as generally the specific gravity of the carrier is bigger than the specific gravity of the toner. Thus, the carrier fluctuates over time in the use.

However, the properties of the toner and the carrier contained in the developer containing member 231 are controlled to make the supplying property of the toner and the carrier coated with the toner maintain a uniform rate. This allows the ratio of the toner and the carrier in the developer supplied to the developing device (image developing unit) 10 to be kept at a constant state, even if the developer container 230 is structured without using a stirring member.

Specifically, for example, by means of improving the flowability of the toner or adhering property of the toner to the carrier, the supplying property of the toner and the carrier can be close to a uniform rate. The flowability of the toner can be improved by increasing the addition amount of the external additive to the toner particles, and spheronizing the shape of the toner particles. The adhering property of the toner to the carrier is realized by improving the charge property of the toner, or making the diameter of the toner particles smaller.

The property of the toner and the carrier in the developer contained in the developer containing member 231 is prepared appropriately, and the developer satisfies the relation of the formula (1) below, related to a percentage of voids A of the toner calculated from a tap density of the toner in the developer, and a degree of fluidity B (sec/50 g) of the developer at a toner coverage ratio of the carrier being 50%. This enables the supplying property of the toner and the carrier coated with the toner to be at a uniform rate, and in the developer the ratio of the toner and the carrier which are supplied to developing device 10 to be kept at a constant state.

$$A \leqq 0.01 \times B - 0.2 \quad (1)$$

In formula (1), the percentage of voids A is used as an index of flowability of the toner alone, and the degree of fluidity B is used as an index of flowability of the developer consisting of the carrier coated with the toner. The smaller the percentage of voids A is, the better the flowability of the toner becomes, and the larger the degree of fluidity B is, the better the flowability of the developer becomes.

When the percentage of voids A is bigger than the value calculated from right-hand side of the formula (1) above, the flowability of the toner alone is insufficient. Therefore, the supplying property of the toner alone is insufficient compared to the supplying property of the carrier, and the supplying ratio between the toner and the carrier cannot be kept at a constant state, then the ratio between the toner and the carrier in the developer supplied to the developing device (image developing unit) 10 fluctuates.

When the ratio between the toner and the carrier in the developer supplied to the developing device (image developing unit) 10, the toner density in the developing device (image developing unit) 10 changes. Therefore, the stable developing properties cannot be obtained, and the charge amount of the toner in the developing device (image developing unit) 10 fluctuates. These cause to generate abnormal images such as background smear.

The percentage of voids A can be adjusted by changing particle size distribution of the toner particles, and changing an addition amount or kinds of external additives such as silica. Specifically, the smaller the particle size of the toner and larger the amount of fine powder are made, the bigger the percentage of voids tends to be, on the contrary, the larger the particle size of the toner and smaller the amount of fine powder are made, the smaller the percentage of voids tends to be. The flowability of the toner is improved by increasing the addition amount of the external additive, and as a result, the percentage of voids A can be smaller. That is, the smaller the value of the percentage of voids A is, the higher the flowability of the toner becomes.

A degree of fluidity of the developer is used as the index of flowability of the carrier. Since the mass abundance ratio of the toner to the carrier is within the above-described range, all carriers in the developer container 230 are completely coated with the toner. Thus, the flowability of the carrier must be evaluated on the carrier coated with the toner.

In the present invention, a degree of fluidity B of the developer at a toner coverage ratio of the carrier being 50% is used as the index of the flowability of the carrier in the developer container 230 for convenience.

Percentage of Voids A

The percentage of voids A is calculated in the following manner.

The measuring method of a percentage of voids A of a toner:

(1) Measuring method of a true density of a toner: A stainless-steel cylinder with an inner diameter of 10 mm and a length of about 5 cm, a disk with an outer diameter of approximately 10 mm and a height of 5 mm (A) which can be inserted in close contact with the stainless-steel cylinder, and a piston with an outer diameter of approximately 10 mm and a height of about 8 cm (B) are prepared. The disk (A) for the bottom of the cylinder is inserted, and approximately 1 g of a sample to be measured is inserted, and the piston (B) is gently pressed into. Then, a force of 400 kg/cm$^2$ is put out the sample by an oil hydraulic press and the sample is taken out after being compressed for 5 minutes. Weighing (wg) the compressed sample, and measuring the diameter (Dcm) and height (Lcm) of the compressed sample with a micrometer, then the true density is calculated by the following formula.

$$\text{True density } (\text{g/cm}^3) = \frac{W}{\pi \times (D/2)^2 \times L} \quad (2)$$

(2) Measuring method of a tap density of a toner: a tap density of a toner (g/cm$^3$) is the value measured by using Powder Tester by Hosokawa Micron Corporation and a container attached to the Powder Tester according to the instruction for Powder Tester.

(3) A percentage of voids of a toner is calculated from the following formula (3).

$$\text{percentage of voids} = \frac{(\text{true density}) - (\text{tap density})}{(\text{true density})} \quad (3)$$

For the flowability of the toner, the percentage of voids A calculated from the above-description is preferably 0.3 to 0.6. When the percentage of voids A of the toner is less than 0.3, the toner is unlikely to be charged uniformly, thus the problems occur, for example, the image density is reduced, and many fogs are generated. When the percentage of voids A is more than 0.6, the flowability of the toner becomes worse, and when the developer is supplied to developing device 10, the supplying property of the toner is impaired.

Toner Coverage Ratio of Carrier

In the present invention as the index of the flowability of the carrier, the degree of fluidity on the condition that the ratio of a carrier which is covered with a toner is 50% is used. The toner coverage on the carrier is calculated from the following formula (4).

$$F = (\sqrt{3} / (2\pi)) \times \frac{dc \times \rho c \times Ct}{dt \times \rho t \times Cc} \times 100 \quad (4)$$

In the formula (4), "dt" represents an average particle diameter of a toner (μm), and "dc" represents an average particle diameter of a carrier (μm), "pt" represents a true specific gravity of a toner, "pc" represents a true specific gravity of a carrier, "Ct" represents a mass part of a toner, and "Cc" represents a mass part of a carrier.

Measuring Method of Degree of Fluidity B of the Developer at a Toner Coverage Ratio of the Carrier being 50%

The degree of fluidity B of the developer is measured in the following way. That is, the toner and the carrier are mixed at a predetermined ratio, in this embodiment at the ratio that the toner coverage on the carrier is 50%, at the temperature of 23° C.±2° C. and the humidity of 60%±3%, and measured after left to stand for one hour. The measuring method is based on JIS-Z2502.

Figure 8:
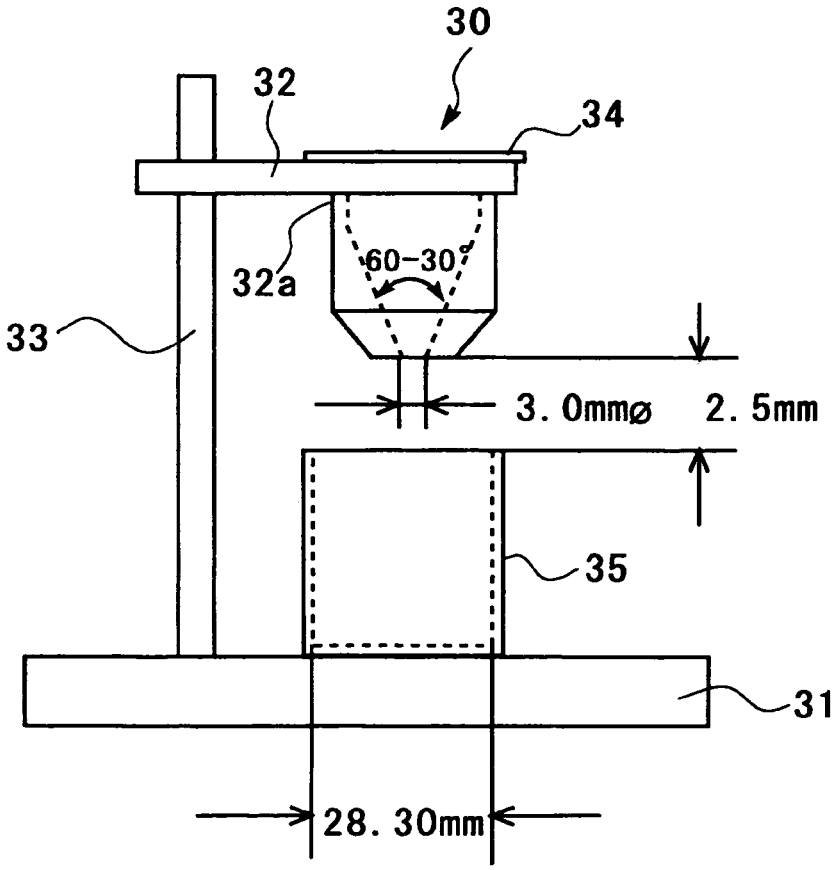
FIG. 8 shows an example of a rheometry for the developer which is used in the present invention.

FIG. 8 shows an example of a rheometry for the developer relating to the embodiment of the present invention.

In FIG. 8, a rheometry 30 consists of a supporting mount 31, a funnel supporting equipment 32, a support 33 which locates the funnel supporting equipment 32 to the supporting mount 31 in the predetermined height, and the support 33 is installed substantially perpendicular to the supporting mount 31. In the funnel supporting equipment 32, a support portion 32*a* which supports the funnel 34 in a plate-like portion projected from the support 33 is provided, and the funnel 34 is inserted from above in the support portion 32*a* to support the funnel 34. Vessel 35 such as a cup is placed on a supporting mount 31 below the funnel 34 so that the vessel 35 receives the developer flows out from the funnel 34.

As the flowability of the carrier, the degree of fluidity B is more preferably 40 to 120 (sec/50 g) at 50% of the toner coverage on the carrier. When the degree of fluidity B is more than 120 sec/50 g, the flowability is bad and the developer cannot be supplied smoothly to the developing device (image developing unit) 10. Then, the image deterioration occurs. When the degree of fluidity B is less than 40 sec/50 g, the small aggregates are observed in the developer flow. Then toner scattering and background smear occur.

Average Circularity

The average circularity of the toner is preferably 0.94 to 0.99.

It is defined that Average Circularity SR=(the circumference of an equivalent circle having the same area as the projected area of the shape of toner particle/the circumference of the projected image of the shape of toner particle)× 100%. The closer to perfect sphere the toner is, the closer to 100% the value becomes. The toner having the high circularity tends to be effected from a development field, and is developed truly along an electric field of a latent electrostatic image. When minute latent image dots are reproduced, the reproducibility of thin line is enhanced by developing densely and uniformly. The toner having high circularity tends to be effected from an electric field because the surface of the toner has a smooth and moderate flowability, and the rate of transfer increases as the toner tends to transfer truly along an electric field. Thus a high grade image can be obtained. However, when the average circularity of the toner is less than 0.94, a true development and transfer at high rate cannot be performed. Therefore, average circularity is preferably 0.94 or more.

The circularity for the toner produced by dry grind is thermally or mechanically spheronized. The thermal treatment may be carried out, for example, toner base body particles are sprayed with thermal current into an atomizer. The mechanical treatment may be carried out, for example, the toner is put and stirred with a mixing media having light specific gravity such as a glass in a mixer such as ball mill. However, in the thermal spheronized treatment, toner base body particles having big particle diameter due to aggregation, or in the mechanical spheronized treatment fine powder may be produced, thus further classifying step may be needed. The shape of the toner which is prepared in an aqueous medium is controlled by stirring strongly in removing solvent step.

When the average circularity is within the above range, an appropriate density and high-resolution image can be formed with high reproducibility.

The average circularity of the toner can be measured with flow-type particle image analyzer FPIA-2000 by Sysmex Corp. Specifically, the measurement is performed by adding 0.1 ml to 0.5 ml of a surfactant, preferably alkylbenzene sulfonate, as a dispersing agent to 100 ml to 150 ml of water from which solid impurities are removed in advance in a container, and then 0.1 g to 0.5 g of measuring sample is added and dispersed. The suspension is subjected to dispersion treatment for approximately 1 minute to 3 minutes using an ultrasonic disperser, and the shapes and distribution of the toner are measured by the above apparatus at a dispersion concentration of 3,000/μl to 10,000/μl and the average circularity is calculated from the result above.

Toner Mass Average Particle Diameter and D4/Dn

The mass average particle diameter of the toner is preferably 3 μm to 8 μm. By using the toner having the mass average particle diameter of 8 μm or less, a dot reproducibility can be improved, a latent electrostatic image can be densely developed, and an adhering property to the carrier can be improved. As the adhering property to the carrier is improved, in the developing device toner charge amount is stable, thus an excellent image can be obtained.

On the other hand, when the mass average particle diameter is less than 3 μm, the toner of two-component developer is likely to fuse onto the carrier surfaces as a result of stirring in the developing unit for a long period and the charging capability of magnetic carrier may be deteriorated. Thus it is not preferred.

The ratio (D4/Dn) of the mass average particle diameter (D4) to the number average particle diameter (Dn) in the toner is more preferably 1.00 to 1.40. As D4/Dn is defined in this way, the toner for high resolution and high image quality can be obtained.

To obtain much higher image quality, preferably, D4 is 3 μm to 7 μm, D4/Dn is 1.00 to 1.20, and particles of 3 μm or less is 1% by number to 10% by number, more preferably, D4 is 3 μm to 6 μm, and D4/Dn is 1.00 to 1.15. These toners are excellent in heat-resistant storage stability, fixing property at low temperatures and hot offset resistance, especially, excellent in glossiness of image in case that the toner is used for full-color copiers. Moreover, the two-component developer using the toner of the invention exhibits less fluctuation in the toner particle diameter in the developer after toner inflow/outflow for a long period of time, and the excellent and stable developing property can be obtained after stirring in a developing device for a long period of time.

The above-described mass average particle diameter (D4) may be measured using a measuring device of a Coulter counter TA-II, and Coulter Multisizer (both by Beckman Coulter Inc.).

The measuring method is as follows: at first 0.1 ml to 5 ml of a surfactant, preferably alkylbenzene sulfonate, as a dispersing agent is added to 100 ml to 150 ml of electrolytic aqueous solution. An electrolyte herein is made by preparing approximately 1 mass % NaCl aqueous solution with primary sodium chloride using ISOTON R-II (by Coulter Scientific Japan). In addition, 2 mg to 20 mg of the measuring sample is added thereto, and dispersed in the electrolyte. The suspension is subjected to dispersion treatment for approximately 1 minute to 3 minutes using an ultrasonic disperser. In the above measuring apparatus, using 100 μm aperture the volume and numbers in the toner particles in the sample is measured on each channel, and the volume distribution and number distribution of the toner are calculated. Then, mass average particle diameter (D4) of the toner based on mass standard is calculated from the volume distribution of the toner particles, i.e. a median of each channel is a representative value of each channel, is obtained.

As channels 13 channels are used: from 2.00 μm or more to less than 2.52 μm; from 2.52 μm or more to less than 3.17 μm; from 3.17 μm or more to less than 4.00 μm; from 4.00 μm or more to less than 5.04 μm; from 5.04 μm or more to less than 6.35 μm; from 6.35 μm or more to less than 8.00 μm; from 8.00 μm or more to less than 10.08 μm; from 10.08 μm or more to less than 12.70 μm; from 12.70 μm or more to less than 16.00 μm; from 16.00 μm or more to less than 20.20 μm; from 20.20 μm or more to less than 25.40 μm; from 25.40 μm or more to less than 32.00 μm; and from 32.00 μm or more to less than 40.30 μm.

Specifically, the average particle diameter and particle size distribution of the toner is measured using Coulter counter TA-II connected with an Interface producing a number distribution and a volume distribution (by The Institute of Japanese Union of Scientists & Engineers) and a personal computer PC9801 (by NEC Corporation).

Average Charge Amount of Toner

The average charge amount of the toner in the developer in developer container 230 is preferably 30 (μC/g) to 50 (μC/g).

In two-component developing system, the toner in the developer is charged by contacting with the carrier, and the adhering property of the toner with the carrier is secured by electrostatic force. When many toners lacking the charge amount exist in the developer, the toner cannot adhere to the surface of the carrier, and many toners suspend in the developer, thus the phenomena such as background smear and toner scattering are easily occur.

When the average charge amount of the toner in the developer is 30 μC/g or more, almost all the toner have enough charge amount to adhere onto the surface of the carrier, and an excellent image without background smear and toner scattering on the image can be obtained.

When the average charge amount of the toner in the developer is less that 30 μC/g, a weakly charged toner which causes background smear and toner scattering is produced, and stable developing property cannot be obtained.

When the average charge amount of the toner is more than 50 μC/g, the adhering force between a toner and a magnetic carrier is too strong to develop necessary amount of the toner on photoconductor drum 1 even by applying developing bias. Thereby fails to obtain enough image density.

As the average charge amount of the toner in developer container 230 is set within the range from 30 μC/g to 50 μC/g, the background smear and toner scattering are prevented, and the reduction of the image density due to the reduction of the amount of the developing toner is prevented. Thus the stable developing property can be obtained in developing device 10.

The method for measuring charge amount distribution in the invention will be illustrated. In the present invention, the method of measuring using blow-off device disclosed in Japanese Patent Application Laid-Open (JP-A) No. 2004-264510 is adopted. The device has a unit for detecting an amount of charge influx to a blow-off cell or efflux from a blow-off cell, and can change gradually an air suction pressure from the lower side, and an air blow pressure from the upper side. When the blow pressure is weak, only the toners having small charge amount are blown off In accordance with increasing the blow pressure, the toners having higher charge amount can be blown off Therefore, the distribution of the charge amount of the developer can be measured in the way that the mass of the toners which are blown off with predetermined blow pressure and able to be suctioned is measured, and the amount of charge efflux or influx is measured repeatedly by an electrometer with increasing the blow pressure in stages from low pressure.

The measuring method for the charge amount in the present invention is performed as follows:

At normal temperature and normal humidity, 7% of toner density, the toner and the carrier are mixed for predetermined hours, subsequently the mixed toner and carrier is put in a measuring gage in which a sieve of 635 μm mesh is set and blown-off for 30 seconds. The charge amount Q (μC) and mass M (g) of the scattered fine particles is measured, then the charge amount Q/M (μC/g) is found from the charge amount Q (μC) and mass M (g).

[Carrier for Two-Component Developer]

The toner used in the present invention may be used as a two-component developer by mixing with the magnetic carrier.

Example of the magnetic carrier used includes the known ones such as iron powder, ferrite powder, and magnetite powder and magnetic resin carrier. Among these, the magnetic resin carrier is particularly preferable.

The magnetic resin carrier contains a core material and a coat film coating the core material.

The materials of the coat film are not limited and can be appropriately selected according to applications. Examples thereof include a urea-formaldehyde resin, a melamine resin, a benzoguanamine resin, a urea resin, a polyamide resin, an epoxy resin, an acrylic resin, a polymethylmethacrylate resin, a polyacrylonitrile resin, a polyvinyl acetate resin, a polyvinyl alcohol resin, a polyvinyl butyral resin, a polystyrene resin, a styrene-acrylic copolymer resin, a polyvinyl chloride resin, a polyethylene terephthalate resin, a polybutylene terephthalate resin, a polycarbonate resin, a polyethylene resin, a polyvinyl fluoride resin, a polyvinylidene fluoride resin, a polytrifluoroethylene resin, a polyhexafluoropropylene resin, a copolymer of vinylidene fluoride and an acrylic monomer, a copolymer of vinylidene fluoride and vinyl fluoride, fluoroterpolymers such as a terpolymer of tetrafluoroethylene, vinylidene fluoride and nonfluorinated monomer and a silicone resin.

The coat film may optionally include a conductive powder according to requirements. Examples of the conductive powder include metal powder, carbon black, titanium oxide, tin oxide and zinc oxide. The average particle diameter of these conductive powders is preferably 1 μm or less. When the average particle diameter is more than 1 μm, it may be difficult to control the electric resistance.

Mass Average Particle Diameter of Carrier (Dc)

The mass average particle diameter of the magnetic carrier used is preferably 20 μm to 40 μm. When the average particle diameter is less than 20 μm, the carrier particles are likely to adhere onto a photoconductor. When the average particle diameter is more than 40 μm, the mixing property with the toner is low, and when toner density is high, the surface area of the carrier particles necessary enough to frictional-charge the toner promptly cannot be obtained. Therefore a poorly charged toner is easily produced and a high resolution image is difficultly obtained.

In the present invention, the mass average particle diameter Dw relating to the carrier is calculated on the particle distribution of the particles which is measured based on number standard, i.e. the relation between number frequency and particle diameter. In this case, the mass average particle diameter Dw is represented as the following formula.

$$Dw=\{1/\Sigma(nD^3)\}\times\{\Sigma(nD^4)\} \quad (5)$$

in the formula (5), "D" represents a representative particle diameter of the particles which exist in each channel (μm), and "n" represents a total number of the particles which exit in each channel.

The channel represents the length which divides equally diameter range in the particle distribution map. The length of 2 μm is adopted in the present invention. As a representative particle diameter of the particles exist in each channel, the maximum value of the particle diameter storing in each channel is adopted.

As the particle size analyzer to measure a particle distribution MICROTRACK particle size analyzer (model HRA 9320-X 100 by Honewell Co. Ltd.) is used.

The measurement condition is as follows:

(1) the rang of a particle diameter: 100 μm to 8 μm (2) the length of a channel (width of a channel): 2 μm (3) the number of channels: 46

Dry Milling Method

The Example of the method for producing toner include, but not limited to, milling, polymerization such as suspension polymerization, emulsion polymerization, dispersion polymerization, emulsion flocculation, emulsion coagulation. An example of the milling method is as follow: at first, the above-described resin, a pigment or a dye as a colorant, a charge control agent, a releasing agent and other additives are well mixed by a mixer such as HENSCHEL MIXER, subsequently, the components are mixed well using a batch kneader such as a two-roll mill and Banbury mixer, or a continuous double-screw extruder or a heat-kneader such as a continuous single-screw kneader, after cold-rolled the toner mixture is cut. The cut toner mixture is coarsely crushed by means of a hammer mill, and further finely milled by means of a jet mill and other mechanical grinders, and classified to a predetermined particle size using a classifier using swirl flow or a classifier base on Coanda effect. Then, an additives consisting of inorganic particles is adhered or fixed to the surface of the particles by a mixer.

Solution Polymerization Method

The toner is obtained by subjecting a liquid containing toner materials to a crosslinking and/or elongation reaction in an aqueous medium. The liquid contaning toner materials is formed by dissolving and/or dispersing at least a component having an active hydrogen group, a polymer having a part which can react with the active hydrogen, a polyester, a colorant and a releasing agent in an organic solvent. The components of the toner and the method for producing the toner are illustrated hereinafter.

The toner of the present invention contains a modified polyester (i) as a binder resin. A modified polyester (i) indicates a polyester in which a combined group other than ester bond may reside in a polyester resin, and different resin components are combined into a polyester resin through covalent bond, ionic bond or the like. Specifically, a modified polyester is the one that a functional group such as an isocyanate group or the like, which reacts to a carboxylic acid group and a hydrogen group, is introduced to a polyester end and further reacted to an active hydrogen-containing compound to modify the polyester end.

A modified polyesters (i) include an urea-modified polyester which is obtained by the reaction between a polyester prepolymer having an isocyanate group (A) and amines (B). Examples of this prepolymer having an isocyanate group (A) is a polycondensate of a polyol (PO) and a polycarboxylic acid (PC) and a product of a reaction in which a polyester having an active hydrogen is reacted with a polyisocyanate (PIC). Examples of a group having an active hydrogen contained in the polyester include a hydroxyl group such as alcoholic hydroxyl group and a phenolie hydroxyl group; an amino group; a carboxylic group; and a mercapto group. Among these, an alcoholic hydroxyl group is preferable.

The urea-modified polyester is produced as the following way described below.

Examples of the polyol (PO) include a diol (DIO) and a polyol with three or more valences (TO). It is preferably a DIO alone or a mixture of DIO with a small amount of TO. Examples of the diol (DIO) include an alkylene glycol such as ethylene glycol, 1,2-propylene glycol 1,3-propylene glycol, 1,4-butanediol and 1,6-hexanediol; an alkylene ether glycol such as diethylene glycol, triethylene glycol dipropylene glycol, polyethylene glycol, polypropylene glycol and polytetramethylene ether glycol; an alicyclic diol such as 1,4-cyclohexane dimethanol and hydrogenated bisphenol A; a bisphenol such as bisphenol A, bisphenol F and bisphenol S; an adduct of an alkylene oxide of the aliphatic diol such as ethylene oxide, propylene oxide and butylene oxide; and an adduct of the bisphenol of an alkylene oxide such as ethylene oxide, propylene oxide and butylene oxide. Among these, an alkylene glycol having a carbon number of 2 to 12 and an alkylene oxide adduct of bisphenol are preferable. The combination of an alkylene glycol having a carbon number of 2 to 12 and an alkylene oxide adduct of bisphenol is particularly preferable. Examples of the polyol having three or more valences (TO) include a polyvalent aliphatic alcohol with three to eight valences or more such as glycerin, trimethylolethane, trimethylolpropane, pentaerythritol and sorbitol; a phenol having three or more valences such as trisphenol PA, phenol novolac and cresol novolac; and an alkylene oxide adduct of the polyphenol having three or more valences.

Examples of the polycarboxylic acid (PC) include a dicarboxylic acid (DIC) and a polycarboxylic acid with three or more valences (TC); a DIC alone and a combination of DIC and a small amount of TC are preferable. Examples of the dicarboxylic acid include an alkylene dicarboxylic acid such as succinic acid, adipic acid and sebacic acid; an alkenylene dicarboxylic acid such as maleic acid and fumaric acid; and an aromatic dicarboxylic acid such as phthalic acid, isophthalic acid, terephthalic acid and naphthalenedicaroboxylic acid. Among these, an alkenylene dicarboxylic acid having a carbon number of 4 to 20 and an aromatic dicarboxylic acid having a carbon number of 8 to 20 are preferable. Examples of the polycarboxylic acid with three or more valences (TC) include an aromatic polycarboxylic acid having a carbon number of 9 to 20 such as trimellitic acid and pyromellitic acid. Here, regarding a polycarboxylic acid (PC), an anhydride of the above mentioned compounds or a lower alkylester such as methyl ester, ethyl ester and isopropyl ester may be used to react with the polyol (PO).

The ratio of the polyol (PO) to the polycarboxylic acid (PC) is, defined as an equivalent ratio [OH]/[COOH] of a hydroxyl group [OH] to a carboxyl group [COOH], usually 2/1 to 1/1, preferably 1.5/1 to 1/1, and more preferably 1.3/1 to 1.02/1.

Examples of the polyisocyanate (PIC) include an aliphatic polyisocyanate such as tetramethylene diisocyanate, hexamethylene diisocyanate, and 2,6-diisocyanato methyl caproate; an ahcyclic polyisocyanate such as isophorone diisocyanate, and cyclohexyl methane diisocyanate; an aromatic diisocyanate such as tolylene diisocyanate and diphenylmethane diisocyanate; an aromatic-aliphatic diisocyanate such as α,α,α',α'-tetramethylxylene diisocyanate; an isocyanurate; the polyisocyanate blocked by phenol derivative, oxime and caprolactam; and a combination of two or more of the above components.

The ratio of the polyisocyanate (PIC) is, defined as an equivalent ratio [NCO]/[OH] of an isocyanate [NCO] to a hydroxyl group [OH] of the polyester having a hydroxyl group, usually 5/1 to 1/1, preferably 4/1 to 1.2/1, and more preferably 2.5/1 to 1.5/1. When the ratio of [NCO]/[OH] is more than 5, the low-temperature fixing property decreases. When the molar ratio of [NCO] is less than 1, in case of the urea-modified polyester, the urea content of the polyester decreases, and the hot offset resistance degrades.

The content of the polyisocyanate (PIC) constituent in the polyester prepolymer having an isocyanate group at its end (A) is usually 0.5% by mass to 40% by mass, preferably 1% by mass to 30% by mass, and more preferably 2% by mass to 20% by mass. The content of less than 0.5% by mass degrades the hot offset resistance, and it is disadvantageous in terms of the compatibility between the heat-resistant storage stability and the low-temperature fixing property as well. When it is more than 40% by mass, the low-temperature fixing property degrades. The number of isocyanate group included in one molecule of polyester prepolymer having an isocyanate group (A) is usually one or more, preferably 1.5 to 3 on average, and more preferably 1.8 to 2.5 on average. When it is less than one per molecule, the molecular mass of the urea-modified polyester reduces, and the hot offset resistance degrades.

Examples of the amines (B) to be reacted with a polyester prepolymer (A) include a diamine compound (B1), a polyamine compound with three or more valences (B2), an amino alcohol (B3), an amino mercaptan (B4), an amino acid (B5) and a component in which an amino group of B1 to B5 is blocked (B6).

The diamine compound (B1) include an aromatic diamine such as phenylene diamine, diethyltoluene diamine, and 4,4'-diaminodiphenylmethane; an alicyclic diamine such as 4,4'-diamino-3,3'-dimethyldicyclohexylmethane, diamine cyclohexane and isophorone diamine; and an aliphatic diamine such as ethylene diamine, tetramethylene diamine and hexamethylene diamine. Examples of the polyamine compounds with three or more valences (B2) include diethylenetriamine and triethylenetetramme. Examples of the amino alcohol (B3) include ethanolamine and hydroxyethylaniline. Examples of the amino mercaptan (B4) include an ammomethyl mercaptan and aminopropyl mercaptan. Examples of the amino acid (B5) include aminopropionic acid and aminocaproic acid. Examples of the component in which an amino group of B1 to B5 is blocked (B6) include a ketimine compound obtained from the amines B1 to B5 and ketones such as acetone, methyl ethyl ketone and methyl isobutyl ketone; and an oxazolidine compound. Among these amines (B), B1 and a mixture of B1 with a small amount of B2 are preferable.

The ratio of the amines (B) is, defined as an equivalent ratio [NCO]/[$NH_x$] of an isocyanate [NCO] in the polyester repolymer having an isocyanate group (A) to an amino group [$NH_x$] in the amines (B), usually 1/2 to 2/1, preferably 1.5/1 to 1/1.5, and more preferably 1.2/1 to 1/1.2. When the ratio of [NCO]/[$NH_x$] is more than 2 or less than 1/2, the molecular mass of the urea-modified polyester decreases, and the hot offset resistance degrades.

The polyester modified with urea bonding may contain a urethane bonding as well as urea bonding. The molar ratio of the urea-bonding content to urethane-bonding content is usually 100/0 to 10/90, preferably 80/20 to 20/80, and more preferably 60/40 to 30/70. When the molar ratio of the urea bonding is less than 10%, the hot offset resistance degrades.

The modified polyester (i) used in the present invention may be produced by means of the one-shot method or the prepolymer method. The mass-average molecular mass of the modified polyester (i) is usually 10,000 or greater, preferably 20,000 to 10,000,000, more preferably 30,000 to 1,000,000. The molecular mass peak is preferably 1,000 to 10,000, and when less than 1,000, it is hard to be subjected to elongation reactions, and the toner elasticity is low, thus hot-offset resistance is poor. When it is more than 10,000, it may cause degradation of fixing property and may bring hard challenges in manufacturing in yielding toner fine particles and in toner grinding. The number average molecular mass of the modified polyester (i) is not limited when a unmodified polyester (ii) hereinafter mentioned is used, and a suitable number average molecular mass may be chosen to obtain easily the mass-average molecular mass. In case of modified polyester (i) alone, the number average molecular mass is usually 20,000 or less, preferably 1,000 to 10,000, and more preferably 2,000 to 8,000. When it is more than 20,000, the low-temperature fixing property and the gloss property for the use in a full-color device degrade.

A terminator may be optionally used for cross-linking and/or elongation between the polyester prepolymer (A) and the amines (B) to obtain the modified polyester (i) to adjust the molecular mass of the urea-modified polyester to be obtained. Examples of the terminator include monoamine such as diethylamine, dibutylamine, butylamine and laurylamine; and a ketimine compound that the amine functionalities of the above components are blocked.

In the present invention, not only the modified polyester (i) may be used alone but also an unmodified polyester (ii) may be included together with the modified polyester (i) as binder resin components. Using an unmodified polyester (ii) in combination with a modified polyester (i) is preferable to the use of the modified polyester (i) alone, because low-temperature fixing properties and gloss properties when used in a full-color device become improved. Examples of the unmodified polyester (ii) include a polycondensation polyester of a polyvalent alcohol (PO) and a polyvalent carboxylic acid (PC), and the like, same as in the modified polyester (i) components. Preferable compounds thereof are also the same as in the modified polyester (i). As for the unmodified polyester (ii), in addition to an unmodified polyester, it may be a polymer which is modified by a chemical bond other than urea bonds, for example, it may be modified by a urethane bond. It is preferable that at least a part of modified polyester (i) is compatible with part of an unmodified polyester (ii), from the aspect of low-temperature fixing properties and hot-offset resistance. Thus, it is preferable that the composition of the modified polyester (i) is similar to that of the unmodified polyester (ii). A mass ratio of a modified polyester (i) to an unmodified polyester (ii) when an unmodified polyester (ii) being included, is usually 5/95 to 80/20, preferably 5/95 to 30/70, more preferably 5/95 to 25/75, and still more preferably 7/93 to 20/80. When the mass ratio of a modified polyester (i) is less than 5%, it makes hot-offset resistance degraded and brings about disadvantages in compatibility between heat-resistant storage stability and low-temperature fixing properties.

The peak molecular mass of (ii) is usually 1,000 to 10,000, preferably 2,000 to 8,000, and more preferably 2,000 to 5,000. When the quantity having a molecular mass of less than 1,000 increases, the heat-resistant storage stability tends to degrade, and when more than 10,000, low-temperature fixing properties becomes degraded. The hydroxyl value of (ii) is preferably 5 mg KOH/g or greater, more preferably 10 to 120, and still most preferably 20 to 80. When it is less than five, it is disadvantageous in terms of the compatibility between the heat-resistant storage stability and the low-temperature fixing property.

The acid value of (ii) is preferably 1 mg KOH/g to 5 mg KOH/g, and more preferably 2 mg KOH/g to 4 mg KOH/g. Since a wax with a high acid value is used, a binder with a low acid value leads to charging and a high volume resistivity. Thus, the binder with a low acid value is easily matched with a toner used in a two-component developer, The glass transition temperature (Tg) of the binder resin is usually 35° C. to 70° C., and preferably 55° C. to 65° C. When it is less than 35° C., the heat-resistant storage stability of the toner degrades. When it is more than 70 ° C., the low-temperature fixing property is insufficient. As the urea-modified polyester tends to exist on the surface of the obtained toner base particle, a toner of the present invention shows a tendency of having the preferable heat-resistant storage stability even with a low glass transition temperature compared to the known polyester toner.

As a colorant of the present invention, the known dyes and pigments may be used. Examples thereof include carbon black, nigrosine dye, iron black, naphthol yellow S, Hanza Yellow (10G, 5G, G), cadmium yellow, yellow iron oxide, ocher, chrome yellow, titanium yellow, polyazo yellow, oil yellow, Hanza Yellow (GR, A, RN, R), Pigment Yellow L, benzidine yellow (G, GR), Permanent Yellow (NCG), Balkan Fast Yellow (5G, R), Tartrazine lake, quinoline yellow lake, anthrazine yellow BGL, isoindolinone yellow, iron oxide red, minium, crocosite, cadmium red, cadmium mercury red, antimony vermilion, permanent red 4R, Para Red, Phiser Red, parachloro-o-nitroaniline red, Resol Fast Scarlet G, Brilliant Fast Scarlet, Brilliant Carmine BS, permanent red (F2R, F4R, FRL, FRLL, F4RH), Fast Scarlet VD, Balkan Fast Rubin B, Brilliant Scarlet G, Resol Rubin GX, Permanent Red F5R, Brilliant Carmine 6B, Pigment Scarlet 3B, Bordeaux 5B, Toluidine Maroon, Permanent Bordeaux F2K, Hefflio Bordeaux BL, Bordeaux 10B, Bon Maroon Light, Bon Maroon Medium, eosine lake, Rhodamine Lake B, Rhodamine Lake Y, Alizaline Lake, thioindigo red B, thioindigo maroon, oil red, quinacridone red, pyrazoline red, polyazo red, chromium vermilion, benzidine orange, perinone orange, oil orange, cobalt blue, cerulean blue, alkali blue lake, peacock blue lake, Victoria blue lake, nonmetallic phthalocyanine blue, fast sky blue, Indanthrene Blue (RS, BC), indigo, ultramarine, Prussian blue, anthraquinone blue, Fast Violet B, Methyl Violet Lake, cobalt purple, manganese purple, dioxane violet, anthraquinone violet, chromium green, zinc green, chromium oxide, pyridian, emerald green, Pigment Green B, Naphthol Green B, green gold, acid green lake, malachite green lake, phthalocyanine green, anthraquinone green, titanium oxide, zinc white, lithopone and the mixture thereof The composition of the colorant with respect to the toner is preferably 1% by mass to 15% by mass, and more preferably 3% by mass to 10% by mass.

The colorant used in the present invention may be used as a master batch in a composite with a resin as well. Examples of the binding resin which is used in the production of the master batch or kneaded with the master batch include, a styrene and a polymer of the substitution product thereof such as polystyrene, poly-p-chlorostyrene and polyvinyltoluene or a copolymer of the above-noted styrene and vinyl compound; polymethylmethacrylate, polybutylmethacrylate, polyvinyl chloride, polyvinyl acetate, polyethylene, polypropylene, polyester, epoxy resins, epoxy polyol resins, polyurethanes, polyamides, polyvinyl butyral, polyacrylic resins, rosin, modified rosin, terpene resin, aliphatic or alicyclic hydrocarbon resins, aromatic petroleum resins, chlorinated paraffin and paraffin wax. These may be used alone or in combination.

As charge control agent of the present invention, the known charge control agent may be used, and examples of the charge control agents include a nigrosine dye, a triphenylmethane dye, a metal complex dye containing chromium, a molybdic acid chelate pigment, a Rhodamine dye, alkoxy amine, quaternary ammonium salt including fluorine-modified quaternary ammonium salt, alkylamide, phosphorus as an element or a compound, tungsten as an element or a compound, fluorine activator, metal salt of a salicylic acid and metal salt of salicylic acid derivative.

Specific examples thereof include BONTRON 03 (nigrosine dye), BONTRON P-51 (quaternary ammonium salt), BONTRON S-34 (metallized azo dye), E-82 (metal complex of oxynaphthoic acid), E-84 (metal complex of salicylic acid) and E-89 (phenolic condensate), manufactured by Orient Chemical Industries, Ltd.; TP-302 and TP-415 (molybdenum complex of quaternary ammonium salt) manufactured by Hodogaya Chemical Co., LTD.; COPY CHARGE PSY VP2038 (quaternary ammonium salt), COPY BLUE PR (triphenyl methane derivative), COPY CHARGE NEG VP2036 and NX VP434 (quaternary ammonium salt), manufactured by Hoechst AG; LRA-901 and LR-147 (boron complex), manufactured by Japan Carlit Co., Ltd.; copper phthalocyanine, perylene, quinacridone, azo pigments and polymers having a functional group such as sulfonate group, carboxyl group and quaternary ammonium group. Among the charge control agents, a substance capable of controlling a toner to a negative polarity is preferably used.

The amount of the charge control agent used in the present invention varies depending on the manufacturing method including the type of the binding resin, the presence or absence of the optionally used additives and the dispersion method, and it may not be unambiguously determined. It is, however, based on 100 parts by mass of the binding resin, preferably 0.1 parts by mass to 10 parts by mass, more preferably 0.2 parts by mass to 5 parts by mass. The amount of the charge control agent exceeding 10 parts by mass increases the charge property too much and weakens the effect of the charge control agent. The increase of the electrostatic attraction with a developing roller causes the decrease in the flowability of the developer and the image quality.

As a releasing agent a wax leaving a low melting point of 50° C. to 120° C. which is dispersed in a binder resin is more effectively works on the phase boundary between a fixing roller and a toner. This effects on high temperature offsets without any applications of a releasing agent like a oil to a fixing roller. The wax components are as follows. Waxes include vegetable waxes such as carnauba wax, cotton wax, wood wax, rice wax; animal waxes such as beeswax, and lanolin; mineral waxes such as ozokerite and ceresin; the petroleum wax such as paraffin wax, microcrystalline wax, and petrolatum. Examples of waxes include, other than these natural waxes, the synthetic hydrocarbon such as Fischer-Tropsch wax and polyethylene wax, synthetic wax such as ester, ketone, ether. Further, it is also possible to use a polyacrylate homopolymer such as poly-n-stearyl methacrylate, and poly-n-lauril methacrylate being a fatty acid and a low-molecular-mass crystalline polymer resin such as 12-hydroxy stearic acid amide, stearic acid amide, phthalic anhydride imide, and chlorinated hydrocarbon or a copolymer such as a n-stearyl acrylate-ethylmethacrylate copolymer, and the like; and a crystalline polymer having a long alkyl group in its side chain such as a n-stearylacrylate-ethyl-methacrylate copolymer.

These charge control agents and releasing agents may be dissolved and dispersed after being melted and kneaded with the master batch and the binder resin; it may of course be added directly to the organic solvent in dissolution and dispersion.

Inorganic particles are preferably used as an external additive for assisting in fluidity of toner particles, developing properties, and charge properties.

The primary particle diameter of the inorganic fine particle is preferably 5 nm to 2 μm, more preferably 5 nm to 500 nm. The specific surface are of the inorganic fine particle by BET method is preferably 20 $m^2/g$ to 500 $m^2/g$.

The amount of the inorganic fine particle is preferably 1.3 parts by mass to 4.5 parts by mass based on 100 parts by mass of the toner base body.

When the amount of the inorganic fine particle added is less than 1.3 parts by mass, the flowability is worsened and an enough charge amount cannot be obtained.

When the amount of the inorganic fine particle added is 4.5 parts by mass or more, the external additive is released from the surface of the toner and a stable flowability and charge properties cannot be obtained.

Examples of the inorganic particles include silica, alumina, titanium oxide, barium titanate, magnesium titanate, calcium titanate, strontium titanate, zinc oxide, tin oxide, silica sand, clay, mica, wollastonite, diatom earth, chrome oxide, cerium oxide, colcothar, antimony trioxide, magnesium oxide, zirconium oxide, barium sulfate, barium carbonate, calcium carbonate, silicon carbide and silicon nitride.

These external additives are surface-treated to enhance its hydrophobic property, and it can prevent the degradation of the flowability and charge property even under high humidity. Preferable examples of the surface treatment agents include a silane coupling agent, a silylation agent, a silane coupling agent having an alkyl fluoride group, an organic titanate coupling agent, an aluminate coupling agent, a silicone oil and a modified silicone oil.

Among the inorganic particles a silica is most preferably used as an external additive. This allows to obtain the toner having good flowability and charge property.

When the silica particle is used as an external additive, the average diameter is preferably 50 nm to 260 nm. When the average diameter is less than 50 nm, the silica particle is embedded in the toner and cannot obtain sufficient flowability. When the average diameter is 260 nm or more, the external additive particle is easily released from the surface of the toner, and sufficient flowability and stable charge property cannot be obtained.

The preferable method for producing the toner according to the present invention will be explained with respect to exemplary aspects, but not limited to.

1) A liquid containing toner raw materials is prepared through dispersing or dissolving a colorant, an unmodofied-polyester, a polyester prepolymer having an isocyanate group, and a releasing agent into an organic solvent.

The organic solvent is preferably volatile and has a boiling point lower than 100° C. in terms of easy removal after the toner base particles being formed. Specific examples of the organic solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methylacetate, ethylacetate, methyl ethyl ketone, methyl isobutyl ketone. These solvents can be used alone or in combination. Among these solvents, aromatic solvents such as toluene and xylene; and halogenated hydrocarbons such as methylene chloride, 1,2-dichloroethane, chloroform, and carbon tetrachloride are preferably used. The addition quantity of the solvent is from 0 part by mass to 300 parts by mass, preferably from 0 part by mass to 100 parts by mass, and more preferably from 25 parts by mass to 70 parts by mass based on 100 parts by mass of the polyester prepolymer.

2) The liquid that contains toner raw materials is emulsified in an aqueous medium under the presence of a surfactant and resin fine particles. The aqueous medium may be water alone, alternatively the aqueous medium may contain an organic solvent as alcohol such as methanol, isopropyl alcohol, and ethylene glycol; dimethylformamide; tetrahydrofuran; cellosolves such as methyl cellosolve; and a lower ketone such as acetone and methyl ethyl ketone.

The amount of the aqueous medium is preferably 50 parts by mass to 2,000 parts by mass, more preferably 100 parts by mass to 1,000 parts by mass based on 100 parts by mass of the liquid containing toner raw materials. When the amount is less than 50 parts by mass, the liquid containing toner raw materials disperses insufficiently within the aqueous medium to obtain toner particles with predetermined particle diameter; the amount of above 2,000 parts by mass leads to higher cost.

In order to arrange properly the dispersion condition within the aqueous medium, dispersing agents such as surfactants and resin fine particles may be added optionally.

The surfactant include an anionic surfactant such as alkylbenzene sulfonate, α-rolefin-sulfonate and phosphate; a cationic surfactant of amine salt type such as alkylamine salt, amino alcohol fatty acid derivative, polyamine alcohol fatty acid derivative and imidazoline; a cationic surfactant of quaternary ammonium salt type such as alkyltrimethyl ammonium salt, dialkyldimethyl ammonium salt, alkyldimethylbenzyl ammonium salt, pyridinium salt, alkylisoquinolinium salt and benzethonium chloride; a nonionic surfactant such as fatty amide derivative and polyol derivative; and an amphoteric surfactant such as alanine, dodecyldi(ammoethyl)glycine, di(octylaminoethyl)glycine and N-alkyl-N,N-dimethyl ammonium betaine.

In addition, the use of a surfactant having a fluoroalkyl group may largely enhance the effect even in a small amount. Examples of the preferably used anionic surfactants havmg a fluoroalkyl group includes fluoroalkylcarboxylate having a carbon number of 2 to 10 and its metal salt, perfluoro octanesulfonyl disodium glutamate, 3-[omega-fluoroalkyloxy ($C_6$ to $C_{11}$)]-1-alkyl ($C_3$ to $C_4$) sodium sulfonate, 3-[omega-fluoroalkanoyl ($C_6$ to $C_8$-N-ethylamino]-1-propane sodium sulfonate, fluornalkyl ($C_{11}$ to $C_{20}$) carboxylic acid and its metal salt, perfluoroalkyl carboxylic acid ($C_7$ to $C_{13}$) and its metal salt, perfluoroalkyl ($C_4$ to $C_{12}$) sulfonic acid and its metal salt, perfluorooctane sulfonic acid diethanolamide, N-propyl-N-(2-hydroxyethyl)perfluorooctane sulfonamide, perfluoroalkyl ($C_6$ to $C_{10}$) sulfonamidepropyltrimethyl ammonium salt, perfluoroalkyl ($C_6$ to $C_{10}$)-N-ethylsulfonylglycin salt and monoperfluoroalkyl ($C_6$ to $C_{16}$) ethylphosphate.

Examples of commercially available anionic surfactants having a fluoroalkyl group include: SURFLON S-111, S-112 and S-113 manufactured by Asahi Glass Co., Ltd.; Fluorad FC-93, FC-95, FC-98 and FC-129 manufactured by Sumitomo 3M Limited; Unidyne DS-101 and DS-102 manufactured by Daikin Industries, Ltd.; MEGAFACE F-110, F120, F113, F191, F812 and F833 manufactured by DAINIPPON INK AND CHEMICALS, INCORPORATED; EFTOP EF-102, 103, 104, 105, 112, 123A, 123B, 306A, 501, 201 and 204 manufactured by Tohkem Products Co., Ltd.; and FTERGENT F-100 and F150 manufactured by NEOS Co., Ltd.

Also, examples of the cationic surfactant include an aliphatic primary and secondary acids or secondary amine acid; an aliphatic quaternary ammonium salt such as perfluoroalkyl ($C_6$ to $C_{10}$) sulfonamide propyltrimethyl ammonium salt; benzalkonium salt; benzethonium chloride; a pyridinium salt; and an imidazolinium salt. Examples of commercially available cationic surfactants include SURFLON S-121 manufactured by Asahi Glass Co., Ltd.; Fluorad FC-135 manufactured by Sumitomo 3M Limited; Unidyne DS-202 manufactured by Daikin Industries, Ltd.; MEGAFACE F-150 and F-824 manufactured by DAINIPPON INK AND CHEMICALS, INCORPORATED; EFTOP EF-132 manufactured by Tohkem Products Co., Ltd.; and FTERGENT F-300 manufactured by NEOS Co., Ltd.

Any resin may be used for the resin particles as long as it forms an aqueous dispersion, and it may be a thermoplastic resin or a thermosetting resin. Examples thereof include a vinyl resin, a polyurethane resin, an epoxy resin, a polyester resin, a polyamide resin, a polyimide resin, a silicon resin, a phenol resin, a melamine resin, a urea resin, an aniline resin, an ionomer resin and a polycarbonate resin. These resins may be used alone or in combination of two or more types of the resin particles.

Among these, a vinyl resin, a polyurethane resin, an epoxy resin, a polyester resin and a combination thereof are preferable in view of obtaining easily an aqueous dispersoid of fine and spherical resin particles. The vinyl resin is a polymer that a vinyl monomer is homopolymerized or copolymerized, and examples thereof include a styrene-(meth)acrylic ester copolymer, a styrene-butadiene copolymer, a (meth)acrylic acid-acrylic ester polymer, a styrene-acrylonitrile copolymer, a styrene-maleic anhydride copolymer and a styrene-(meth) acrylic acid copolymer. The primary particle diameter of the resin particles is preferably 5 nm to 200 nm, and more preferably 20 nm to 300 nm. Inorganic compound dispersing agent such as tricalcium phosphate, calcium carbonate, titanium oxide, colloidal silica and hydroxyapatite may be used.

The dispersed droplets may be stabilized with a polymeric protective colloid as a usable dispersing agent in combination with the above-described resin particles and inorganic compound dispersing agent. Examples thereof include: an acid such as acrylic acid, methacrylic acid, α-cyanoacrylic acid, α-cyanomethacrylic acid, itaconic acid, crotonic acid, fumaric acid, maleic acid, and maleic anhydride; (meth) acrylic monomer having a hydroxyl group such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylic ester, diethylene glycol monomethacrylic ester, glycerine monoacrylic ester, glycerine monomethacrylic ester, N-methylolacrylamide and N-methylolmethacrylamide; a vinyl alcohol or an ether of vinyl alcohol such as vinyl methyl ether, vinyl ethyl ether and vinyl propyl ether; an ester of vinyl alcohol and a compound having a carboxyl group such as vinyl acetate, vinyl propionate and vinyl butyrate; acrylamide, methacrylamide, diacetone acrylamide and methylol compounds thereof, an acid chloride such as acrylic acid chloride and methacrylic acid chloride; a homopolymer or copolymer of a compound having a nitrogen atom or a heterocyclic ring thereof such as vinylpyridine, vinylpyrrolidone, vinylimidazole and ethyleneimine; a polyoxyethlene compound such as polyoxyethylene, polyoxypropylene, polyoxyethylene alkyl amine, polyoxypropylene alkyl amine, polyoxyethylene alkyl amide, polyoxypropylene alkyl amide, polyoxyethylene nonyl phenyl ether, polyoxyethylene lauryl phenyl ether, polyoxyethylene stearyl phenyl ester and polyoxyethylene nonyl phenyl ester; and celluloses such as methyl cellulose, hydroxyethyl cellulose and hydroxypropyl cellulose.

The dispersion method is not limited, and the known apparatus such as low-speed shearing, high-speed shearing, friction, high-pressure jet and ultrasonic apparatuses may be applied. It is preferably a high-speed shearing apparatus in order to have a particle diameter of the dispersions of 2 μm to 20 μm. For a high-speed sharing distribution apparatus, the number of revolutions is not particularly limited, but it is usually 1,000 rpm to 30,000 rpm, and more preferably 5,000 rpm to 20,000 rpm. The dispersion time is not particularly limited, but in a batch processing system, it is usually 0.1 minutes to 5 minutes. The dispersion temperature is usually 0° C. to 150° C. under pressurization, and preferably 40° C. to 98° C.

3) In parallel with preparation of the emulsified liquid, amines (B) are added to the emulsified liquid to be reacted to a polyester prepolymer having an isocyanate group (A).

This reaction causes the cross-linking and/or elongation reaction of molecular chains. The reaction time is selected depending on a reactivity between a isocyanate group structure which polyester prepolymer (A) has and amine, and usually 10 minutes to 40 hours, preferably 2 hours to 24 hours. The reaction temperature is usually 0° C. to 150° C., preferably 40° C. to 98° C. If necessary, the known catalysts can be used. Specifically, examples of the catalyst include a dibutyltin laurate, and a diocryltin laurate.

4) After completion of the reaction, the organic solvent is removed from the emulsified dispersion or reaction mixture, and the residue is washed and dried to obtain toner base particles.

The entire system is gradually raised in temperature while stirring as a laminar flow, is vigorously stirred at set temperature, and the organic solvent is removed to thereby yield spindle-shaped toner base particles. When calcium phosphate salts or another dispersion stabilizer that is soluble in acid or base is used as a dispersion stabilizer, the calcium phosphate salts is removed from the toner bas particles by dissolving the calcium phosphate salts by action of an acid such as hydrochloric acid and washing the toner base particles with water. Alternatively, the component can be removed, for example, by enzymatic decomposition.

5) A charge control agent is incorporated into the obtained toner 5 base particles, and then inorganic fine particles such as silica fine particles, and titanium oxide fine particles are added to the toner particles as external additives, thereby to yield a toner.

The incorporation of the charge control agent and the external addition of inorganic particles are performed by way of a conventional procedure using a mixer, for example.

Thus, a toner having a narrow particle diameter distribution may be easily produced. In addition, vigorous stirring at removing the organic solvent may control the toner-particle shape between substantial-spherical shape and rugby-ball shape, and the surface of the toner particles may be morphologically controlled within a range from smooth surface to shriveled surface.

(Process Cartridge)

A process cartridge of the present invention includes at least an image bearing member and a developing unit configured to develop the latent electrostatic image on the image bearing member with the developer to form a visible image, and it further includes other units appropriately selected according to requirements.

The developing unit includes at least a developer container that contains the toner and/or the developer and a developer bearing member which bears and transfers the toner or the developer contained in the developer container, and it may further include, for example, a thickness regulation member for regulating the thickness of the toner layer that the member bears.

The process cartridge of the present invention may be detachably provided in various electrophotographic image-forming apparatuses, facsimiles and printers, and it is preferably detachably provided in an image-forming apparatus of the present invention described hereinafter.

Figure 10:
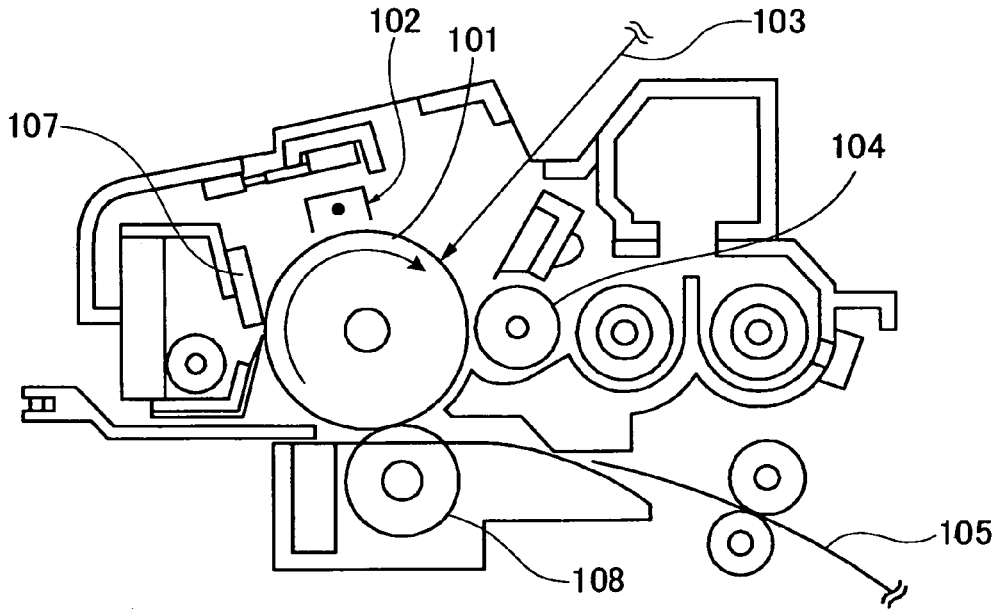
FIG. 10 is a schematic view showing an example of a process cartridge of the present invention.

The process cartridge, for example, as shown in FIG. 10, houses a latent electrostatic image bearing member 101. It also includes a charging unit 102, an image developing unit 104, a transferring unit 108, and a cleaning unit 107 and it further includes other members according to requirements. In FIG. 10, 103 and 105 indicate an exposure light by an exposing unit and a recording medium, respectively.

Next, an image-forming process by means of the process cartridge shown in FIG. 10 is illustrated. A latent electrostatic image corresponding to an exposure image is formed on the surface of the latent electrostatic image bearing member 101, which rotates in the direction of the arrow by the charge from the charging unit 102 and exposure 103 from an exposing unit (not shown). This latent electrostatic image is developed by means of the image developing unit 104, and the obtained visible image is transferred to the recording medium 105 by the transferring unit 108, and then printed out. Next, the surface of the latent electrostatic image bearing member after the image transfer is cleaned with the cleaning unit 107 and further discharged by a discharging unit (not shown). The above operations are repeated again.

EXAMPLES

The present invention will be described in further detail with reference to several examples below, which are not intended to limit the scope of the present invention. All parts and percentage (%) are expressed by mass unless indicated otherwise.

In the Examples and Comparative Examples, "Percentage of Voids of Toner", "Degree of Fluidity of the Developer", "Mass Average Particle Diameter and Number Average Particle Diameter of Toner", "Average Circularity of Toner", "Charge Amount", "Mass Average Particle Diameter of Carrier", and "Thickness of Coat Film of Carrier" were measured by the following methods.

<Measuring Method of Percentage of Voids A of Toner>

(1) Measuring method of a true density of a toner: a stainless-steel cylinder with an inner diameter of 10 mm and a length of about 5 cm, a disk with an outer diameter of approximately 10 mm and a height of 5 mm (A) which could be inserted in close contact with the stainless-steel cylinder, and a piston with an outer diameter of approximately 10 mm and a height of about 8 cm (B) were prepared. The disk (A) for the bottom of the cylinder was inserted, and approximately 1 g of a sample to be measured was inserted, and the piston (B) was gently pressed into. Then, a force of 400 kg/cm$^2$ was put out the sample by an oil hydraulic press and the sample was taken out after compressed for 5 minutes. Weighing (wg) the compressed sample, and measuring the diameter (Dcm) and height (Lcm) of the compressed sample with a micrometer, then the true density was calculated by the following formula.

$$\text{True density (g/cm}^3) = \frac{W}{\pi \times (D/2)^2 \times L} \quad (2)$$

(2) Measuring method of a tap density of a toner: a tap density of a toner (g/cm$^3$) was the value measured by using Powder Tester by Hosokawa Micron Corporation and a container attached to the Powder Tester according to the instruction for Powder Tester.

(3) A percentage of voids A of a toner was calculated from the following formula (3).

$$\text{percentage of voids} = \frac{(\text{true density}) - (\text{tap density})}{(\text{true density})} \quad (3)$$

<Measuring Method of Degree of Fluidity B of Developer>

The degree of fluidity B of the developer was measured as the following way. That is, the toner and the carrier were mixed at a predetermined ratio, in this embodiment at the ratio that the toner coverage on the carrier was 50%, at the temperature of 23° C.±2° C. and the humidity of 60%±3%, and measured after left to stand for one hour. The measuring method was based on JIS-Z2502.

<Measuring Method of Mass Average Particle Diameter and Number Average Particle Diameter of Toner>

The above-described mass average particle diameter (D4) and number average particle diameter were measured using a measuring device of a Coulter counter TA-II (by Beckman Coulter Inc.).

The measuring method was as follows: at first 0.1 ml to 5 ml of a surfactant, alkylbenzene sulfonate, as a dispersing agent was added to 100 ml to 150 ml of electrolytic aqueous solution. An electrolyte herein was made by preparing approximately 1 mass % NaCl aqueous solution with primary sodium chloride using ISOTON R-II (by Coulter Scientific Japan). In addition, 2 mg to 20 mg of the measuring sample was added thereto, and dispersed in the electrolyte. The suspension was subjected to dispersion treatment for approximately 1 minute to 3 minutes using an ultrasonic disperser. In the above measuring apparatus, using 100μm aperture the volume and numbers in the toner particles in the sample was measured on each channel, and the volume distribution and number distribution of the toner were calculated. Then, mass average particle diameter (D4) of the toner based on mass standard was calculated from the volume distribution of the toner particles, i.e. a median of each channel was a representative value of each channel, was obtained.

As channels 13 channels were used: from 2.00 μm or more to less than 2.52 μm; from 2.52 μm or more to less than 3.17 μm; from 3.17 μm or more to less than 4.00 μm; from 4.00 μm or more to less than 5.04 μm; from 5.04 μm or more to less than 6.35 μm; from 6.35 μm or more to less than 8.00 μm; from 8.00 μm or more to less than 10.08 μm; from 10.08 μm or more to less than 12.70 μm; from 12.70 μm or more to less than 16.00 μm; from 16.00 μm or more to less than 20.20 μm; from 20.20 μm or more to less than 25.40 μm; from 25.40 μm or more to less than 32.00 μm; and from 32.00 μm or more to less than 40.30 μm.

<Measuring Method of Average Circularity of Toner>

The average circularity of the toner were measured with flow-type particle image analyzer FPIA-2000 by Sysmex Corp. Specifically, the measurement was performed by adding 0.1 ml to 0.5 ml of a surfactant, alkylbenzene sulfonate, as a dispersing agent to 100 ml to 150 ml of water from which solid impurities were removed in advance in a container, and then 0.1 g to 0.5 g of measuring sample was added and dispersed. The suspension was subjected to dispersion treatment for approximately 1 minute to 3 minutes using an ultrasonic disperser, and the shapes and distribution of the toner were measured by the above apparatus at a dispersion concentration of 3,000/μl to 10,000/μl and the average circularity was calculated from the result above.

<Measuring Charge Amount>

At normal temperature and normal humidity, 7% of toner density, the toner and the carrier were mixed for predetermined hours, subsequently the mixed toner and carrier was put in a measuring gage in which a sieve of 635 μm mesh was set and blown-off for 30 seconds. The charge amount Q (μC) and mass M. (g) of the scattered fine particles was measured, then the charge amount Q/M (μC/g) was found from the charge amount Q (μC) and mass M (g). <Measuring Mass Average Particle Diameter of Carrier>

As the particle size analyzer to measure a particle distribution MICROTRACK particle size analyzer (model HRA 9320-X 100 by Honewell Co. Ltd.) was used.

The measurement condition was as follows:

(1) the rang of a particle diameter: 100 μm to 8 μm
(2) the length of a channel (width of a channel): 2 μm
(3) the number of channels: 46

<Measuring Thickness of Coat Film of Carrier>

The thickness of the coat film of the carrier defined in the invention was measured in the way that the film coating the surface of the carrier was observed on the cross section of the carrier with a transmission electron microscope H-9000 NAR by Hitachi, Ltd. Then, 50 carriers were sampled at random from a microphotograph at a magnification of 1,000×, and the film thickness of the coat film was calculated from the average of the film thickness measured at 10 points on respective 50 carriers.

Example 1 of Toner Preparation

~Synthesis of Organic Particle Emulsion~

In a reaction vessel equipped with an agitator and a thermometer, 683 parts of water, 11 parts of a sodium salt of methacrylic acid ethylene oxide adduct sulfate ester (ELEMINOL RS-30, manufactured by Sanyo Chemical Industries, Ltd.), 166 parts of methacrylic acid, 110 parts of butyl acrylate and one part of ammonium persulfate were charged and stirred at 3,800 rpm for 30 minutes to obtain a white emulsion. The emulsion was heated until the temperature in the system reached 75° C. and reacted for 3 hours. Furthermore, 30 parts of 1% aqueous solution of ammonium persulfate was added, and the mixture was aged at 75° C. for 5 hours to obtain an aqueous dispersion of a vinyl resin (copolymer of methacrylic acid-butyl acrylate-sodium salt of sulfate of methacrylic acid ethylene oxide adduct), "Fine Particle Dispersion 1". The volume average particle diameter of "Fine Particle Dispersion 1" was measured by LA-920, and found to be 75 nm. A part of "Fine Particle Dispersion 1" was dried to isolate the resin component. The glass transition temperature (Tg) of the resin component was 60° C., and the mass average molecular mass was 110,000.

~Preparation of Aqueous Phase~

990 parts of water, 83 parts of "Fine Particle Dispersion 1", 37 parts of a 48.3% aqueous solution of sodium dodecyldiphenyl ether disulfonate (ELEMINOL MON-7, manufactured by Sanyo Chemical Industries, Ltd.) and 90 parts of ethyl acetate were mixed and stirred to obtain a milky white liquid, which was hereinafter referred to as "Aqueous Phase 1".

~Synthesis of Low-Molecular Polyester~

In a reaction vessel equipped with a condenser tube, an agitator and a nitrogen introduction tube, 229 parts of bisphenol A ethylene oxide 2 mole adduct, 529 parts of bisphenol A propylene oxide 3 mole adduct, 208 parts of terephthalic acid, 46 parts of adipic acid and 2 parts of dibutyl tin oxide were charged and reacted at a normal pressure and a temperature of 230° C. for 7 hours. After it was further reacted at a reduced pressure of 10 mmHg to 15 mmHg for 5 hours, 44 parts of trimellitic anhydride was added to the reaction vessel. The mixture was reacted at a normal pressure and a temperature of 180° C. over 3 hours to obtain "Low-Molecular Polyester 1". "Low-Molecular Polyester 1" had a number-average molecular mass of 2,300, a mass-average molecular mass of 6,700, a glass transition temperature (Tg) of 43° C. and an acid value of 25 mg KOH/g.

~Synthesis of Intermediate Polyester~

In a reaction vessel equipped with a condenser tube, an agitator and a nitrogen introduction tube, 682 parts of bisphenol A ethylene oxide 2 mole adduct, 81 parts of bisphenol A propylene oxide 2 mole adduct, 283 parts of terephthalic acid, 22 parts of trimellitic anhydride and 2 parts of dibutyl tin oxide were charged and reacted at a normal pressure and a temperature of 230° C. for 7 hours. It was further reacted at a reduced pressure of 10 mmHg to 15 mmHg for 5 hours to obtain "Intermediate Polyester 1". "Intermediate Polyester 1" had a number average molecular mass of 2,200, a mass average molecular mass of 9,700, a glass transition temperature (Tg) of 54° C., an acid value of 0.5 mg KOH/g and a hydroxyl value of 52 mg KOH/g.

Next, in a reaction vessel equipped with a condenser tube, an agitator and a nitrogen introduction tube, 410 parts of "Intermediate Polyester 1", 89 parts of isophorone diisocyanate and 500 parts of ethyl acetate were charged and reacted at a temperature of 100° C. for 5 hours to obtain "Prepolymer 1". "Prepolymer 1" had a free isocyanate content of 1.53% by mass.

~Synthesis of Ketimine~

In a reaction vessel equipped with an agitator and a thermometer, 170 parts of isophorone diamine and 75 parts of methyl ethyl ketone were charged and reacted at a temperature of 50° C. for 4.5 hours to obtain "Ketimine Compound 1". "Ketimine Compound 1" had an amine value of 417 mg KOH/g.

~Synthesis of Master Batch (MB)~

In HENSCHEL MIXER manufactured by MITSUI MINING COMPANY, LIMITED, 600 parts of water, 800 parts of C. I. Pigment blue 15:3 wet cake having a solid content of 50%, and 1,200 parts of a polyester resin were added and mixed. After it was kneaded using a two-roll mill at a temperature of 120° C. over 45 minutes, the mixture was cold-rolled and then milled with a pulverizer to obtain "Master Batch 1".

~Preparation of Oil Phase~

In a vessel with an agitator and a thermometer, 378 parts of "Low-Molecular Polyester 1", 100 parts of carnauba wax, and 947 parts of ethyl acetate were charged. After it was heated to 80° C. under agitation and maintained for 5 hours while keeping the temperature at 80° C., the mixture was cooled to 30° C. in one hour. Next, 500 parts of "Master Batch 1" and 500 parts of ethyl acetate were charged in a vessel, which was mixed for one hour to obtain "Raw Material Solution 1".

In a vessel, 1,324 parts of "Raw Material Solution 1" was transferred, and the pigment and the wax were dispersed in three passes using a bead mill, Ultraviscomill manufactured by Aimex Co., Ltd., filled at 80% by volume with 0.5-mm zirconia beads under conditions of a liquid feeding rate of 1 kg/hr and a disk circumferential velocity of 6 m/sec. Next, 1,324 parts of 65% ethyl acetate solution of "Low-Molecular Polyester 1" was added, and the mixture was dispersed in a two passes under the same conditions as above to obtain "Pigment-Wax Dispersion 1". "Pigment-Wax Dispersion 1" had a solid concentration of 53% (130° C. and 30 minutes).

~Emulsification and Desolvation~

In a vessel, 749 parts of "Pigment-Wax Dispersion 1", 115 parts of "Prepolymer 1" and 2.9 parts of "Ketimine Compound 1" were charged and mixed with T.K. HOMO MIXER manufactured by Tokushu Kika Kogyo Co., Ltd. at 5,000 rpm for 2 minutes. Then, 1,200 parts of "Aqueous Phase 1" was added to the vessel, and the mixture was mixed with T.K HOMO MIXER at 13,000 rpm for 25 minutes to obtain "Emulsified Slurry 1".

In a vessel equipped with an agitator and a thermometer, "Emulsified Slurry 1" was introduced and desolvated at 30° C. for 8 hours. Then, it was aged at 45° C. for 7 hours to obtain "Dispersed Slurry 1".

~Washing and Drying~

After 100 parts of "Dispersed Slurry 1" was filtered under a reduced pressure:

(1) 100 parts of ion-exchanged water was added to the filter cake, mixed with T.K HOMO MIXER at 12,000 rpm for 10 minutes and then filtered;

(2) 100 parts of 10% sodium hydroxide solution was added to the filter cake of (1), mixed with T.K HOMO MIXER at 12,000 rpm for 30 minutes and then filtered under a reduced pressure;

(3) 100 parts of 10% hydrochloric acid was added to the filter cake of (2), mixed with T.K HOMO MIXER at 12,000 rpm for 10 minutes and then filtered; and (4) the operation of adding 300 parts of ion-exchanged water was added to the filter cake of (3), mixed with T.K. HOMO MIXER at 12,000 rpm for 10 minutes followed by filtration was repeated twice to obtain "Filter Cake 1".

"Filter Cake 1" was dried in a circulating air drier at 45° C. for 48 hours.

Then, a fluorine compound was mixed to be 0.1 mass % with respect to the toner base body in an aqueous medium phase in which the fluorine compound expressed by the following structural formula was dispersed at a 1 mass % concentration. After the fluorine compound was adhered, or bonded to the toner base body and dried at 45° C. for 48 hours in a circulating air dryer followed by drying the mixture at 30° C. for 10 hours in a container. Thereafter, the mixture was shieved through a sieve of 75 μm mesh, thereby obtained a "Toner Base Body Particle 1".

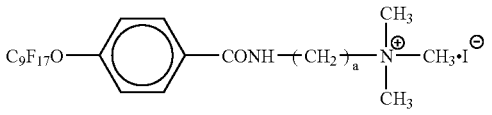

Next, 100 parts of "Toner Base Body Particle 1", 1.0 part of hydrophobic silica with a primary particle diameter of 10 nm (external additive A), 1.5 parts of substantial-spherical hexamethyldisilazane hydrophobic silica with a primary particle diameter of 110 nm (external additive B) produced by sol-gel method, and 1.0 part of hydrophobic titanium oxide with primary particle diameter of 15 nm (external additive C) were mixed in HENSCHEL MIXER (by Mitsui Mining Co., Ltd. FM20C). Thus, toner was obtained.

The mixing was carried out by repeating 10 times of stirring for 30 seconds at circumferential speed of 30 m/sec and allowing to leave to stand for 60 seconds. The toner obtained is referred to as "Toner 1".

Example 2 of Toner Preparation

~Preparation of "Low-Molecular Polyester 2"~

460 g of polyoxypropylene (2.2)-2,2-bis(4-hydroxyphenyl) propane, 72 g of ethylene glycol 306 g of terephthalic acid, 90 g of 1,2,4-benzenetricarboxylic anhydride (trimellitic anhydride), and 1.2 g of dibutyl tin oxide were placed in a 2-liter glass flask with four openings, equipped with a thermometer, a stainless-steel agitator, a falling-film condenser, and a nitrogen introduction tube, and reacted by stirrig in a mantle heater in a nitrogen flow at 190° C. for 4 hours, and then at 220° C.

When a glass transition point reached 130° C., the reaction was terminated. The obtained resin was a number average molecular mass of 4,800, mass-average molecular mass of 17,700, a glass transition temperature (Tg) of 63° C. and an acid value of 5 mg KOH/g.

| (Toner Constituting Material) | | |
|---|---|---|
| binder resin: | "Low-Molecular Polyester 1" | 50 parts |
| | "Low-Molecular Polyester 2" | 50 parts |
| colorant: | For yellow toner; Benzimidazolone yellow pigment (C.I. Pigment Yellow 180) | 5 parts |
| | For magenta toner; Quinacridone magenta pigment (C.I. Pigment Red 122) | 4 parts |
| | For cyan toner; Copper phthalocyanine blue pigment (C.I. Pigment Blue 15) | 2 parts |
| | For black toner; Carbon black | 6 parts |
| charge control agent: | zinc salt of salicylic acid derivative | 2 parts |
| releasing agent: | carnauba wax | 5 parts |

After each color of the toner constituting material was mixed well with a blender, it was melt-kneaded by a double-screw extruder heated at 100° C. to 110° C. After the kneaded mixture was left to cool, milled coarsely with a cutter mill, and then milled with a pulverizing mill using jet stream. By using a wind-force classifier a "Toner Base Body Particle 2", which is each toner base body particles of each toner, was obtained. Subsequently, 100 parts of "Toner Base Body Particle 2", 1.5 parts of a hydrophobic silica with primary particle diameter of 10 nm (external additive A), 0.5 parts of substantial-spherical hexamethyldisilazane hydrophobic silica with a primary particle diameter of 110 nm (external additive B) produced by sol-gel method, and 0.5 parts of hydrophobic titanium oxide with a primary particle diameter of 15 nm (external additive C) were mixed in HENSCHEL MIXER (by Mitsui Mining Co., Ltd. FM20C). Thus, toner was obtained.

The mixing was carried out by repeating 10 times of stirring for 30 seconds at circumferential speed of 30 m/sec and allowing to leave to stand for 60 seconds. The toner obtained is referred to as "Toner 2".

Example 3 of Toner Preparation

The toner was prepared by changing the condition of milling and classification to the "Toner Base Body Particle 2" prepared in Example 2 of toner preparation, and obtained a toner with a different particle distribution. The toner obtained is referred to as "Toner 3".

In Table 1, the details of the toner are illustrated.

Example 4 of Toner Preparation

The toner was prepared by changing the condition of milling and classification to the "Toner Base Body Particle 2" prepared in Example 2 of toner preparation, and obtained a toner with a different particle distribution. The toner obtained is referred to as "Toner 4".

In Table 1, the details of the toner are illustrated.

Example 5 of Toner Preparation

~Preparation of "Low-Molecular Polyester 3"~

740 g of polyoxypropylene (2.2)-2,2-bis(4-hydroxyphenyl) propane, 300 g of polyoxyethylene (2.2)-2,2-bis(4-hydroxyphenyl) propane, 466 g of dimethyl terephthalate, 80 g of isododecenyl succinic anhydride, 114 g of 1,2,4-benzenetricarboxylic acid tri-n-butyl were placed in a 2-liter glass flask with four openings, equipped with a thermometer, a stainless-steel agitator, a falling-film condenser, and a nitrogen introduction tube, and reacted by stirring in a mantle heater in a nitrogen flow in the first half at a normal pressure and a temperature of 210° C., and then in the second half at a reduced pressure and a temperature of 210° C. (100 mmHg).

The obtained resin was a number average molecular mass of 5,200, mass-average molecular mass of 26,500, a glass transition temperature (Tg) of 64° C. and an acid value of 2.3 mg KOH/g.

Except that the "Low-Molecular Polyester 3" was used in stead of the "Low-Molecular Polyester 2" in Example 2 of toner preparation, the toner was prepared in the same way as Example 2 of toner preparation.

The toner obtained is referred to as "Toner 5". In Table 1, the details of the toner are illustrated.

Example 1 of Carrier Preparation

| | |
|---|---|
| acrylic resin solution (solid content 50 mass %) | 21.0 parts |
| guanamine solution (solid content 70 mass %) | 6.4 parts |
| alumina particle [particle diameter 0.3 μm, resistivity $10^{14}$ (Ω · cm)] | 7.6 parts |
| silicone resin solution [solid content 23 mass % (SR2410: by Dow Corning Toray Silicone Co., Ltd.)] | 65.0 parts |
| aminosilane [solid content 100 mass % (SH6020: by Dow Corning Toray Silicone Co., Ltd.)] | 0.3 parts |
| toluene | 60 parts |
| butyl cellosolve | 60 parts |

The above components were dispersed with a homomixer for 10 minutes, then a blend coat film forming solution of acrylic resin and silicone resin containing alumina particles was obtained.

By using calcinated ferrite powder [$(MgO)_{1.8}(MnO)_{49.5}(Fe_2O_3)_{48.0}$: average particle diameter; 35 μm] as a core, the above coat film forming solution was coated to be a thickness of 0.15 μm on the surface of the core by a Spiller Coater (by Okada Seiko Co., Ltd.) and dried. The obtained carrier was baked by leaving to stand in an electric furnace at 150° C. for 1 hour. After cooling, the ferrite powder bulk was grinded and sieved with a sieve of 106 μm mesh, thereby obtained "Carrier 1".

The thickness of the coat film was measured in the way that the film coating the surface of the carrier could be observed on the cross section of the carrier with a transmission electron microscope, and then the thickness was calculated from the average of the thickness. In Table 2, the details of the carrier are illustrated.

Example 2 of Carrier Preparation

| | |
|---|---|
| silicone resin solution [solid content 23 mass % (SR2410: by Dow Corning Toray Silicone Co., Ltd.)] | 100 parts |
| aminosilane [solid content 100 mass % (SH6020: by Dow Corning Toray Silicone Co., Ltd.)] | 0.6 parts |
| toluene | 60 parts |
| butyl cellosolve | 60 parts |

The above components were dispersed with a homomixer for 10 minutes, then a coat film forming solution of silicone resin was obtained.

By using calcinated ferrite powder $[(MgO)_{1.8}(MnO)_{49.5}(Fe_2O_3)_{48.0}$: average particle diameter; 35 μm] as a core, the above coat film forming solution was coated to be a thickness of 0.15 μm on the surface of the core by a Spiller Coater (by Okada Seiko Co., Ltd.), and dried. The obtained carrier was baked by leaving to stand in an electric furnace at 160° C. for 1 hour. After cooling, the ferrite powder bulk was grinded and sieved with a sieve of 106 μm mesh, thereby obtained "Carrier 2".

The thickness of the coat film was measured in the way that the film coating the surface of the carrier could be observed on the cross section of the carrier with a transmission electron microscope, and then the thickness was calculated from the average of the thickness. In Table 2, the details of the carrier are illustrated.

Example 3 of Carrier Preparation

| | |
|---|---|
| acrylic resin solution (solid content 50 mass %) | 11.0 parts |
| guanamine solution (solid content 70 mass %) | 3.4 parts |
| titanium oxide particles [average particle diameter 0.2 μm, resistivity $10^{10}$ (Ω · cm)] | 6.5 parts |
| silicone resin solution [solid content 23 mass % (SR2410: by Dow Corning Toray Silicone Co., Ltd.)] | 35.0 parts |
| aminosilane [solid content 100 mass % (SH6020: by Dow Corning Toray Silicone Co., Ltd.)] | 0.2 parts |
| toluene | 150 parts |
| butyl cellosolve | 150 parts |

The above component substances were dispersed with a homomixer for 10 minutes, then a blend coating film forming solution of acrylic resin and silicone resin containing alumina particles was obtained.

By using calcinated ferrite powder $[(MgO)_{1.5}(MnO)_{49.5}(Fe_2O_3)_{48.5}$: average particle diameter; 65 μm] as a core, the above coat film forming solution was coated to be a thickness of 0.09 μm on the surface of the core by a Spiller Coater (by Okada Seiko Co., Ltd.), and dried. The obtained carrier was baked by leaving to stand in an electric furnace at 150° C. for 1 hour. After cooling, the ferrite powder bulk was grinded and sieved with a sieve of 106 μm mesh, thereby obtained "Carrier 3". In Table 2, the detail of the carrier is illustrated.

Example 4 of Carrier Preparation

| | |
|---|---|
| acrylic resin solution (solid content 50 mass %) | 13.0 parts |
| guanamine solution (solid content 70 mass %) | 4.0 parts |
| titanium oxide particles [average particle diameter 0.2 μm, resistivity $10^{10}$ (Ω · cm)] | 7.2 parts |
| silicone resin solution [solid content 23 mass % (SR2410: by Dow Corning Toray Silicone Co., Ltd.)] | 40.0 parts |
| animosilane [solid content 100 mass % (SH6020: by Dow Corning Toray Silicone Co., Ltd.)] | 0.3 parts |
| toluene | 180 parts |
| butyl cellosolve | 180 parts |

The above components were dispersed with a homomixer for 10 minutes, then a blend coating film forming solution of acrylic resin and silicone resin containing alumina particles was obtained.

By using calcinated ferrite powder $[(MgO)_{1.5}(MnO)_{49.5}(Fe_2O_3)_{48.5}$: average particle diameter; 50 μm] as a core, the above coat film forming solution was coated to be a thickness of 0.10 μm on the surface of the core by a Spiller Coater (by Okada Seiko Co., Ltd.), and dried. The obtained carrier was baked by leaving to stand in an electric furnace at 150° C. for 1 hour. After cooling, the ferrite powder bulk was grinded and sieved with a sieve of 106 μm mesh, thereby obtained "Carrier 4". In Table 2, the details of the carrier are illustrated.

Example 5 of Carrier Preparation

| | |
|---|---|
| acrylic resin solution (solid content 50 mass %) | 22.0 parts |
| guanamine solution (solid content 70 mass %) | 8.0 parts |
| titanium oxide particles [average particle diameter 0.2 μm, resistivity $10^{10}$ (Ω · cm)] | 14.4 parts |
| silicone resin solution [solid content 23 mass % (SR2410: by Dow Corning Toray Silicone Co., Ltd.)] | 70.0 parts |
| aminosilane [solid content 100 mass % (SH6020: by Dow Corning Toray Silicone Co., Ltd.)] | 0.4 parts |
| toluene | 300 parts |
| butyl cellosolve | 300 parts |

The above components were dispersed with a homomixer for 10 minutes, then a blend coating film forming solution of acrylic resin and silicone resin containing alumina particles was obtained.

By using calcinated ferrite powder $[(MgO)_{1.5}(MnO)_{49.5}(Fe_2O_3)_{48.5}$: average particle diameter; 25 μm] as a core, the above coat film forming solution was coated to be a thickness of 0.10 μm on the surface of the core by a Spiller Coater (by Okada Seiko Co., Ltd.), and dried. The obtained carrier was baked by leaving to stand in an electric furnace at 150° C. for 1 hour. After cooling, the ferrite powder bulk was grinded and sieved with a sieve of 106 μm mesh, thereby obtained "Carrier 5". In Table 2, the details of the carrier are illustrated.

<Preparation of Start Developer 1>

5 parts of "Toner 1" and 95 parts of "Carrier 1" were mixed with a tubular mixer for 10 minutes, thereby obtained a start developer.

<Preparations of Start Developer 2 to 13>

The toner and the carrier described in Tables 1 and 2 were mixed with the same condition as the preparation example of start developer 1, thereby obtained each start developer 2 to 13.

<Preparation of Supplying Developers 1>

86 parts of "Toner 1" and 14 parts of "Carrier 1" were mixed with a HENSCHEL MIXER (by Mitsui Mining Co., Ltd. FM20C), thereby obtained supplying developer 1.

The mixing was carried out by repeating 10 times of stirring for 30 seconds at circumferential speed of 30 m/sec and allowing to leave to stand for 60 seconds.

<Preparation of Supplying Developer 2 to 13>

The toner and the carrier described in Tables 1 and 2 were mixed with the same condition as the preparation example of supplying developer 1, thereby obtained each supplying developer 2 to 13.

Example 1

The image-forming apparatus shown in FIG. 1 was used, in which the developing device 10 shown in FIG. 2 was mounted without containing a developer. In addition, 300 g of "Supplying Developer 1" was filled in developer containing member 231 shown in FIG. 6, and placed in developer supplying portion 200 shown in FIG. 3.

The supplying developer was supplied to developing device 10, and taken a sample of the developer which was supplied by approximately 10 g at a time at developer supplying port 14 in FIG. 3, and then measured the mass ratio of the toner and the carrier in the supplying developer. The mass ratio between the first one or at the starting time and the last one or at the last time is described in Table 2.

Next, the developer container was changed and 400 g of start developer 1 was supplied in developing device 10 as shown in FIG. 2, and 100,000 images were printed using a document having 20% of image area ratio in which each 5% of yellow, magenta, cyan, and black. The charge quantity and density of the toner were measured and the obtained images were evaluated each at the time of starting, at the time of printing 50,000 sheets, and at the time of printing 100,000 sheets.

The measurement of the toner density in developing device 10 was performed by measuring the permeability of the developer with the sensor of the toner density (not shown) provided under surface of the developing device 10. The charge quantity of the toner in the developing device was measured with the blow-off device by the above method.

The results of the evaluation are described in Table 3.

Example 2 to Comparative Example 5

By using each of the developer and supplying developer shown in Tables 1 and 2, the evaluations were performed in the same way as Example 1. The results of the evaluation are described in Table 3.

<Image Evaluation>

The image evaluation described in Table 3 will be illustrated hereinafter. The copy test was performed by 100,000 sheets in full-color mode. The obtained image quality was evaluated by the visual observation of background smear. After consecutively printing up to 100,000 sheets of a 3% image-area ratio chart, the following evaluations were performed each at printing 50,000 sheets and 100,000 sheets.

(1) Background Smear

White image was stopped during developing, the developer on a photoconductor after developing was transferred to a tape, the difference in the image density between the sample and a tape without transferring was measured by 938 spectrodensitometer (by X-Rite Co.). The image density was measured with X-Rite manufactured by X-Rite K.K.

TABLE 1

| | supplying developer | | | a percentage of voids A of the toner | a degree of fluidity B of the developer at a toner coverage | details of the toner | |
|---|---|---|---|---|---|---|---|
| | amount of toner (parts by mass) | amount of carrier (parts by mass) | No. | calculated from a tap density of the toner | ratio of the carrier being 50% (sec/50 g) | Toner No. | mass average particle diameter D4 (μm) |
| Example 1 | 90 | 10 | 1 | 0.48 | 70 | 1 | 5.8 |
| Example 2 | 94 | 6 | 2 | | | | |
| Example 3 | 82 | 18 | 3 | | | | |
| Example 4 | 90 | 10 | 4 | | 80 | | |
| Example 5 | 90 | 10 | 5 | 0.50 | 81 | 2 | 6.5 |
| Example 6 | 90 | 10 | 6 | 0.36 | 62 | 3 | 7.5 |
| Example 7 | 90 | 10 | 7 | 0.41 | 68 | 4 | 4.5 |
| Example 8 | 90 | 10 | 8 | 0.54 | 85 | 5 | 6.1 |
| Comparative Example 1 | 96 | 4 | 9 | 0.48 | 70 | 1 | 5.8 |
| Comparative Example 2 | 77 | 23 | 10 | | | | |
| Comparative Example 3 | 90 | 10 | 11 | 0.48 | 65 | | |
| Comparative Example 4 | 90 | 10 | 12 | 0.54 | 73 | 5 | 6.1 |
| Comparative Example 5 | 90 | 10 | 13 | 0.50 | 69 | 2 | 6.5 |

TABLE 1-continued

| | details of the toner | | | | |
|---|---|---|---|---|---|
| | number average particle diameter Dn (μm) | average circularity | external additive 1 | external additive 2 | external additive 3 |
| Example 1<br>Example 2<br>Example 3<br>Example 4 | 5 | 0.98 | 1.0 part by mass of hydrophobic silica (a primary particle diameter of 10 nm) | 1.0 part by mass of hydrophobic silica (a primary particle diameter of 110 nm) | 1.0 part by mass of hydrophobic titanium oxide (a primary particle diameter of 15 nm) |
| Example 5<br>Example 6<br>Example 7<br>Example 8 | 5.4<br>6<br>3.8<br>4.8 | 0.94<br>0.93<br>0.94<br>0.94 | 1.5 parts by mass of hydrophobic silica (a primary particle diameter of 10 nm) | 0.5 parts by mass of hydrophobic silica (a primary particle diameter of 110 nm) | 0.5 parts by mass of hydrophobic titanium oxide (a primary particle diameter of 15 nm) |
| Comparative Example 1<br>Comparative Example 2<br>Comparative Example 3 | 5 | 0.98 | 1.0 part by mass of hydrophobic silica (a primary particle diameter of 10 nm) | 1.0 part by mass of hydrophobic silica (a primary particle diameter of 110 nm) | 1.0 part by mass of hydrophobic titanium oxide (a primary particle diameter of 15 nm) |
| Comparative Example 4<br>Comparative Example 5 | 4.8<br>5.4 | 0.94<br>0.94 | 1.5 parts by mass of hydrophobic silica (a primary particle diameter of 10 nm) | 0.5 parts by mass of hydrophobic silica (a primary particle diameter of 110 nm) | 0.5 parts by mass of hydrophobic titanium oxide (a primary particle diameter of 15 nm) |

TABLE 2

| | details of the carrier | | | | | starting developer | | | | |
|---|---|---|---|---|---|---|---|---|---|---|
| | carrier No. | average particle diameter (μm) | composition of the coated resin | conductive filler | the thickness of the coat film (μm) | toner (parts by mass) | toner No. | carrier (parts by mass) | carrier No. | No. |
| Example 1 | 1 | 35 | silicone resin + acrylic resin | alumina | 0.5 | 5 | 1 | 95 | 1 | 1 |
| Example 2 | | | | | | 5 | | 95 | | 2 |
| Example 3 | | | | | | 5 | | 95 | | 3 |
| Example 4 | 2 | 35 | silicone resin | alumina | 0.5 | 5 | | 95 | 2 | 4 |
| Example 5 | | | | | | 5 | 2 | 95 | | 5 |
| Example 6 | 3 | 65 | silicone resin + acrylic resin | titanium oxide | 0.4 | 5 | 3 | 95 | 3 | 6 |
| Example 7 | 4 | 50 | | titanium oxide | 0.5 | 5 | 4 | 95 | 4 | 7 |
| Example 8 | 5 | 25 | | titanium oxide | 0.6 | 5 | 5 | 95 | 5 | 8 |
| Comparative Example 1 | 1 | 35 | silicone resin + acrylic resin | alumina | 0.5 | 5 | 1 | 95 | 1 | 9 |
| Comparative Example 2 | | | | | | 5 | | 95 | | 10 |
| Comparative Example 3 | 3 | 65 | | titanium oxide | 0.4 | 5 | | 95 | 3 | 11 |
| Comparative Example 4 | 1 | 35 | silicone resin + acrylic resin | alumina | 0.5 | 5 | 5 | 95 | 1 | 12 |
| Comparative Example 5 | 4 | 50 | silicone resin + acrylic resin | titanium oxide | 0.5 | 5 | 2 | 95 | 4 | 13 |

TABLE 3

| | the ratio of supplying amount between toner and carrier | | | | the measured value of the charge amount and density of the toner in the developing device | | | | | | |
|---|---|---|---|---|---|---|---|---|---|---|---|
| | at the start of supplying | | at the last of supplying | | at the time of start | | at the time of printing 50,000 sheets | | at the time of printing 100,000 sheets | | |
| | ratio of toner | ratio of carrier | ratio of toner | ratio of carrier | charge amount (−μC/g) | toner density (wt %) | charge amount (−μC/g) | toner density (wt %) | charge amount (−μC/g) | toner density (wt %) | the state at printing |
| Example 1 | 86 | 14 | 93 | 7 | 25 | 5.0 | 23 | 5.3 | 22 | 5.2 | the charge amount and the toner density of the developer in the developing device was stable. The clear image was maintained. |
| Example 2 | 92 | 8 | 96 | 4 | 25 | 5.0 | 22 | 5.2 | 21 | 4.8 | |
| Example 3 | 78 | 22 | 86 | 14 | 25 | 5.0 | 23 | 5.2 | 24 | 4.6 | |
| Example 4 | 85 | 15 | 93 | 7 | 23 | 4.8 | 20 | 5.2 | 21 | 5.0 | |
| Example 5 | 87 | 13 | 92 | 8 | 22 | 5.1 | 23 | 4.8 | 20 | 4.6 | |
| Example 6 | 84 | 16 | 93 | 7 | 22 | 4.0 | 20 | 4.3 | 21 | 4.2 | |
| Example 7 | 87 | 13 | 92 | 8 | 27 | 4.9 | 26 | 4.8 | 24 | 4.7 | |
| Example 8 | 88 | 12 | 92 | 8 | 26 | 4.0 | 26 | 3.9 | 24 | 3.9 | |
| Comparative Example 1 | 92 | 8 | 99 | 1 | 25 | 5.0 | 15 | 4.8 | 11 | 4.6 | After printing 50,000 sheets, charge amount was reduced and background smear occurred. |
| Comparative Example 2 | 64 | 36 | 98 | 2 | 25 | 5.0 | 18 | 6.0 | 22 | 2.6 | The toner density fluctuated and background smear occurred after printing 50,000 sheets. |
| Comparative Example 3 | 65 | 35 | 97 | 3 | 23 | 4.0 | 21 | 3.3 | 20 | 6.9 | The toner density fluctuated and background smear occurred around printing 100,000 sheets. |
| Comparative Example 4 | 61 | 39 | 99 | 1 | 26 | 5.2 | 24 | 3.5 | 18 | 7.0 | The toner density fluctuated and background smear occurred around printing 100,000 sheets. |
| Comparative Example 5 | 62 | 38 | 98 | 2 | 24 | 4.8 | 20 | 6.8 | 22 | 2.4 | The toner density fluctuated and background smear occurred after printing 50,000 sheets. |

With reference to Table 3, the developer containing the toner and the carrier in Examples 1 to 8 resulted that the stable toner density and charge amount of toner was maintained in the developing device, and clear image was maintained over time in the use.

On the contrary, Comparative Examples 1 to 2, in the developer container, the ratio between the toner and the carrier was not within the stipulated range of the present invention, in Comparative Examples 3 to 5, the flowability of the toner and the flowability of the developer in developer containing member 231 did not satisfy the relation determined in the present invention. At the start of supplying and at the last of the supplying, the supplying ratio between the toner and the carrier ranged widely, and the toner density fluctuated and the charge property changed in the developing device, thus abnormal images such as background smear were obtained over time in the use.

Figure 9:
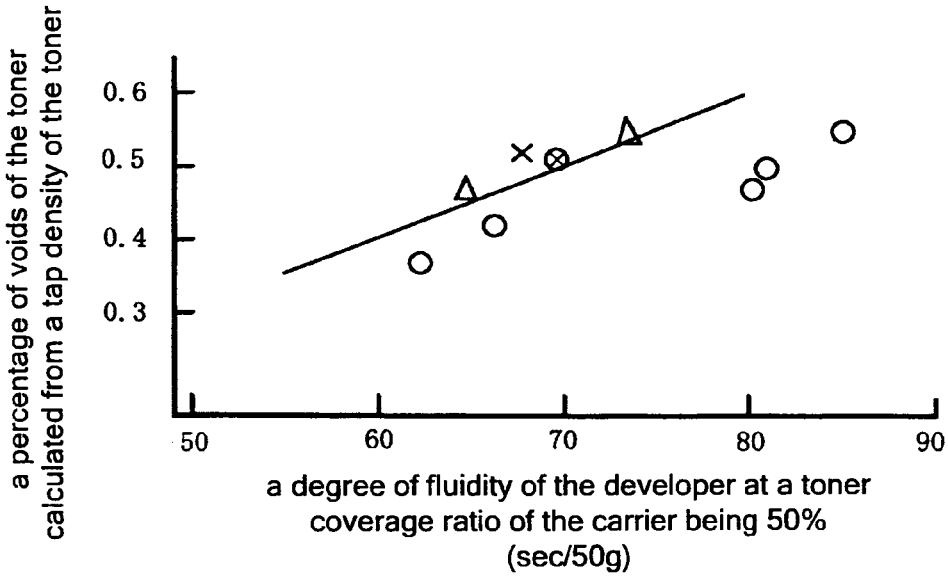
FIG. 9 shows an example of experimental result of the Examples.

FIG. 9 shows an example of experimental result of the examples. The graph shown in FIG. 9 illustrates only a part of the result of the above Examples.

The graph shown in FIG. 9 illustrates the evaluation of images after printing 100,000 sheets of images in the above Examples, a degree of fluidity of the developer at a toner coverage ratio of the carrier being 50% shown in the horizontal axis, and a percentage of voids of the toner calculated from a tap density of the toner in the developer shown in the vertical axis.

'○' represents that the good images could be obtained after printing 100,000 sheets of images, 'Δ' represents that the abnormal image such as background smear occurred on the image after printing 100,000 sheets of images, 'x' represents that the abnormal image such as background smear occurred on the image after printing 50,000 sheets of images.

The percentage of voids A of the toner calculated from a tap density of the toner in the developer container and the degree of fluidity B of the developer at a toner coverage ratio of the carrier being 50% satisfied the relation of the formula (1) $A \leqq 0.01 \times B - 0.2$ which was shown in the area on the lower side of the graph in FIG. 9, the abnormal image such as background smear did not occur on the image after printing 100,000 sheets of images, and good images could be obtained.

On the other hand, the percentage of voids A of the toner in the developer container and the degree of fluidity B of the developer at a toner coverage ratio of the carrier being 50% did not satisfy the relation of the formula (1) which was shown in the area on the upper side of the graph in FIG. 9, the abnormal image such as background smear occurred on the image after printing 50,000 sheets of images.

When the A was approximately equal to the value calculated from right-hand side of the formula (1), referring to Comparative Examples 3 and 4, a good image could be obtained after printing 50,000 sheets of images, but the abnormal image such as background smear was observed on the image after printing 100,000 sheets of images.

What is claimed is:

1. An image-forming apparatus comprising:

an image bearing member, a latent electrostatic image forming unit configured to form a latent electrostatic image on the image bearing member, a developing unit configured to develop the latent electrostatic image on the image bearing member with a developer comprising a toner and a carrier to form a toner image, wherein the developing unit comprises an image developing unit configured to supply the developer to the image bearing member so as to develop the latent electrostatic image, a developer supplying unit configured to supply the developer to the image developing unit, and a developer container contains the developer which is to be supplied to the image developing unit, wherein the developer contained in the developer container has a mass abundance ratio of the toner to the carrier of 80:20 to 95:5, wherein the developer container comprises a flexible pouched member which reduces its volume by reducing the internal pressure thereof, and a developer outlet to discharge the developer contained therein, wherein the developer satisfies a relation of formula (1), where A denotes a percentage of voids of the toner calculated from a tap density of the toner, and B denotes a degree of fluidity (sec/50 g) of the developer at a toner coverage ratio of the carrier being 50%:

$$A \leqq 0.01 \times B - 0.2 \quad (1).$$

2. An image-forming apparatus according to claim 1, the developer outlet is arranged on the lower side of the developer container, when the developer container is disposed so as to connect with the developer supplying unit.

3. An image-forming apparatus according to claim 1, the developer supplying unit further comprises an air supplying unit which supplies air into the developer container.

4. An image-forming apparatus according to claim 1, wherein an average circularity of the toner is 0.94 to 0.99.

5. An image-forming apparatus according to claim 1, wherein the toner comprises toner particles, and an external additive adhered onto a surface of each of the toner particles, and an amount of the external additive is 1.3 parts by mass to 4.5 parts by mass based on 100 parts by mass of the toner particles.

6. An image-forming apparatus according to claim 5, wherein the external additive comprises silica having an average particle diameter of 50 nm to 260 nm.

7. An image-forming apparatus according to claim 1, wherein a mass average particle diameter of the toner is 3 μm to 8 μm.

8. An image-forming apparatus according to claim 1, wherein the percentage of voids A of the toner calculated from the tap density of the toner is 0.3 to 0.6.

9. An image-forming apparatus according to claim 1, wherein an average charge amount of the toner of the developer contained in the developer container is 30 μC/g to 50 μC/g.

10. An image-forming apparatus according to claim 1, wherein a mass average particle diameter of the carrier (Dc) is 20 μm to 40 μm.

11. An image-forming apparatus according to claim 1, wherein the degree of fluidity B of the developer at the toner coverage ratio of the carrier being 50% is 40 sec/50 g to 120 sec/50 g.

12. An image-forming apparatus according to claim 1, wherein a ratio (D4/Dn) of the mass average particle diameter (D4) to the number average particle diameter (Dn) of the toner is 1.00 to 1.40.

13. An image-forming apparatus according to claim 1, wherein the toner is produced by a dry milling method.

14. An image-forming apparatus according to claim 1, wherein the toner is produced by a solution polymerization method.

15. A process cartridge comprising:

an image bearing member bearing a latent electrostatic image, and at least a developing unit disposed oppositely to the image bearing member bearing the latent electrostatic image, wherein the process cartridge is detachably attached to an image-forming apparatus, wherein the image-forming apparatus comprises a developing unit configured to develop the latent electrostatic image on the image bearing member with a developer comprising a toner and a carrier to form a toner image, wherein the developing unit comprises a developer supplying unit configured to supply the developer to the image developing unit, and a developer container contains the developer which is to be supplied to the image developing unit, wherein the developer contained in the developer container has a mass abundance ratio of the toner to the carrier of 80:20 to 95:5, wherein the developer container comprises a flexible pouched member which reduces its volume by reducing the internal pressure thereof and a developer outlet to discharge the developer contained therein, wherein the developer satisfies a relation of formula (1), where A denotes a percentage of voids of the toner calculated from a tap density of the toner, and B denotes a degree of fluidity of the developer at a toner coverage ratio of the carrier being 50%:

$$A \leqq 0.01 \times B - 0.2 \quad (1).$$

16. An image-forming method comprising:

forming a latent electrostatic image on an image bearing member, developing the latent electrostatic image with a developer comprising a toner and a carrier to form a toner image, transferring the toner image on a recording medium, fixing the toner image on the recording medium, wherein the developing is performed by means of a developing unit comprising an image developing unit configured to supply the developer to the image bearing member so as to develop the latent electrostatic image, a developer supplying unit configured to supply the developer to the image developing unit, and a developer container containing the developer which is to be supplied to the image developing unit, wherein the developer contained in the developer container has a mass abundance ratio of the toner to the carrier of 80:20 to 95:5, wherein the developer container comprises a flexible pouched member which reduces its volume by reducing the internal pressure thereof, and a developer outlet to discharge the developer contained therein, wherein the developer satisfies a relation of formula (1), where A denotes a percentage of voids of the toner calculated from a tap density of the toner, and B denotes a degree of fluidity (sec/50 g) of the developer at a toner coverage ratio of the carrier being 50%:

$$A \leqq 0.01 \times B - 0.2 \quad (1).$$

17. An image-forming method according to claim 16, wherein the developer container is supplied with a new developer comprising a toner and a carrier.

* * * * *